US008323103B2

(12) United States Patent
Fabbri

(10) Patent No.: US 8,323,103 B2
(45) Date of Patent: Dec. 4, 2012

(54) SCAN BASED CONFIGURATION CONTROL IN A GAMING ENVIRONMENT

(75) Inventor: Frederic C. Fabbri, Reno, NV (US)

(73) Assignee: IGT, Reno, NV (US)

( * ) Notice: Subject to any disclaimer, the term of this patent is extended or adjusted under 35 U.S.C. 154(b) by 686 days.

(21) Appl. No.: 12/371,427

(22) Filed: Feb. 13, 2009

(65) Prior Publication Data

US 2009/0149245 A1 Jun. 11, 2009

Related U.S. Application Data

(62) Division of application No. 11/207,079, filed on Aug. 17, 2005, now abandoned.

(51) Int. Cl.
*A63F 9/24* (2006.01)

(52) U.S. Cl. ..... 463/29; 463/42

(58) Field of Classification Search ..... 463/25–42, 463/43

See application file for complete search history.

(56) References Cited

U.S. PATENT DOCUMENTS

| | | | |
|---|---|---|---|
| 4,335,809 | A | 6/1982 | Wain |
| 4,342,454 | A | 8/1982 | Baer et al. |
| 4,356,391 | A | 10/1982 | Takeda |
| 4,689,742 | A | 8/1987 | Troy et al. |
| 4,695,053 | A | 9/1987 | Vazquez et al. |
| 4,764,666 | A | 8/1988 | Bergeron |
| 5,043,889 | A | 8/1991 | Lucey |
| 5,073,700 | A | 12/1991 | D'Onofrio |
| 5,110,129 | A | 5/1992 | Alvarez |
| 5,212,369 | A | 5/1993 | Karlisch et al. |
| 5,277,424 | A | 1/1994 | Wilms |
| 5,395,242 | A | 3/1995 | Slye et al. |
| 5,429,361 | A | 7/1995 | Raven et al. |
| 5,452,379 | A | 9/1995 | Poor |
| 5,470,079 | A | 11/1995 | LeStrange et al. |

(Continued)

FOREIGN PATENT DOCUMENTS

DE 4403688 A1 8/1995

(Continued)

OTHER PUBLICATIONS

Aug. 16, 2005, Application No. 02 728 584.0-2221.

(Continued)

*Primary Examiner* — Masud Ahmed
(74) *Attorney, Agent, or Firm* — Weaver Austin Villeneuve & Sampson LLP

(57) ABSTRACT

Techniques are disclosed for facilitating configuration of a gaming machine, and for facilitating authentication testing of selected components of a gaming machine. In at least one embodiment, configuration of the gaming machine may be effected via the use of a gaming machine configuration device. When the presence of a gaming machine configuration device is detected, configuration indicia stored on the configuration device may be accessed and used to determine at least one configuration parameter relating to configuration of the gaming machine. Configuration or reconfiguration of the gaming machine may then be implemented using the at least one configuration parameter. In at least one embodiment, authentication of the gaming machine component may be effected via the use of a gaming machine authentication device. When the presence of a gaming machine authentication device is detected, authentication information stored on the authentication device may be accessed and used to generate authentication output data relating to the component being authenticated. The authentication output data may then be provided to an external entity for verifying the results of the authentication test.

29 Claims, 8 Drawing Sheets

U.S. PATENT DOCUMENTS

| | | | | |
|---|---|---|---|---|
| 5,494,287 | A | 2/1996 | Manz | |
| 5,586,936 | A | 12/1996 | Bennett et al. | |
| 5,655,961 | A | 8/1997 | Acres et al. | |
| 5,679,007 | A | 10/1997 | Potdevin et al. | |
| 5,704,835 | A | 1/1998 | Dietz, II | |
| 5,761,647 | A | 6/1998 | Boushy | |
| 5,779,548 | A | 7/1998 | Asai et al. | |
| 5,820,459 | A | 10/1998 | Acres et al. | |
| 5,830,067 | A | 11/1998 | Graves et al. | |
| 6,001,016 | A | 12/1999 | Walker et al. | |
| 6,003,013 | A | 12/1999 | Boushy | |
| 6,007,426 | A | 12/1999 | Kelly et al. | |
| 6,012,983 | A | 1/2000 | Walker et al. | |
| 6,048,269 | A | 4/2000 | Burns et al. | |
| 6,068,552 | A | 5/2000 | Walker et al. | |
| 6,077,163 | A | 6/2000 | Walker et al. | |
| 6,089,975 | A | 7/2000 | Dunn | |
| 6,099,408 | A | 8/2000 | Schneier et al. | |
| 6,110,041 | A | 8/2000 | Walker et al. | |
| 6,113,495 | A | 9/2000 | Walker et al. | |
| 6,149,522 | A | 11/2000 | Alcorn et al. | |
| 6,162,122 | A | 12/2000 | Acres et al. | |
| 6,165,072 | A | 12/2000 | Davis et al. | |
| 6,183,362 | B1 | 2/2001 | Boushy | |
| 6,186,404 | B1 | 2/2001 | Ehrhart et al. | |
| 6,203,427 | B1 | 3/2001 | Walker et al. | |
| 6,244,958 | B1 * | 6/2001 | Acres | 463/26 |
| 6,254,483 | B1 * | 7/2001 | Acres | 463/26 |
| 6,264,561 | B1 | 7/2001 | Saffari et al. | |
| 6,270,409 | B1 | 8/2001 | Shuster | |
| 6,287,202 | B1 | 9/2001 | Pascal et al. | |
| 6,293,866 | B1 | 9/2001 | Walker et al. | |
| 6,315,665 | B1 | 11/2001 | Faith | |
| 6,343,988 | B1 | 2/2002 | Walker et al. | |
| 6,394,907 | B1 | 5/2002 | Rowe | |
| 6,431,983 | B2 * | 8/2002 | Acres | 463/25 |
| 6,450,885 | B2 | 9/2002 | Schneier et al. | |
| 6,456,977 | B1 | 9/2002 | Wang | |
| 6,478,676 | B1 | 11/2002 | Dayan | |
| 6,511,377 | B1 | 1/2003 | Weiss | |
| 6,645,068 | B1 | 11/2003 | Kelly et al. | |
| 6,645,077 | B2 | 11/2003 | Rowe | |
| 6,675,152 | B1 | 1/2004 | Prasad et al. | |
| 6,685,567 | B2 | 2/2004 | Cockerille et al. | |
| 6,709,333 | B1 | 3/2004 | Bradford et al. | |
| 6,724,385 | B2 | 4/2004 | Takatsuka et al. | |
| 6,743,098 | B2 | 6/2004 | Urie et al. | |
| 6,800,030 | B2 * | 10/2004 | Acres | 463/25 |
| 6,804,763 | B1 | 10/2004 | Stockdale et al. | |
| 6,863,608 | B1 | 3/2005 | LeMay et al. | |
| 6,866,586 | B2 | 3/2005 | Oberberger et al. | |
| 7,040,987 | B2 * | 5/2006 | Walker et al. | 463/42 |
| 2002/0142815 | A1 | 10/2002 | Candelore | |
| 2002/0142825 | A1 | 10/2002 | Lark et al. | |
| 2002/0142846 | A1 | 10/2002 | Paulsen | |
| 2002/0151366 | A1 | 10/2002 | Walker et al. | |
| 2003/0073497 | A1 | 4/2003 | Nelson | |
| 2003/0203756 | A1 | 10/2003 | Jackson | |
| 2004/0002379 | A1 * | 1/2004 | Parrott et al. | 463/29 |
| 2004/0147314 | A1 | 7/2004 | LeMay et al. | |
| 2005/0003883 | A1 | 1/2005 | Muir et al. | |
| 2005/0197191 | A1 * | 9/2005 | McKinley et al. | 463/43 |
| 2006/0154723 | A1 * | 7/2006 | Saffari et al. | 463/29 |

FOREIGN PATENT DOCUMENTS

| | | | |
|---|---|---|---|
| DE | 19905076 | A1 | 8/1999 |
| DE | 19944140 | | 3/2001 |
| EP | 0887753 | A1 | 12/1998 |
| EP | 1039423 | A1 | 9/2000 |
| EP | 1087323 | A1 | 3/2001 |
| EP | 1136930 | A1 | 3/2001 |
| EP | 0396829 | A2 | 10/2004 |
| GB | 2383880 | A | 9/2003 |
| WO | WO 00/38089 | | 6/2000 |
| WO | WO 00/76239 | | 12/2000 |
| WO | WO 00/79489 | | 12/2000 |
| WO | WO 01/75815 | A2 | 10/2001 |
| WO | WO 01/81093 | A2 | 11/2001 |
| WO | WO 02/077935 | A2 | 10/2002 |

OTHER PUBLICATIONS

Communication Pursuant to Article 96(2) EPC, European Patent Office.
International Application No. PCT/US2002/09425.
International Application No. PCT/US2005/026696.
International Search Report dated Oct. 20, 2003, from International Application No. PCT/US03/18307.
Nguyen et al., U.S. Appl. No. 11/078,966, "Secured Virtual Network in a Gaming Environment", filed Mar. 10, 2005.
PCT International Search Report mailed May 28, 2003 for.
PCT International Search Report mailed Nov. 24, 2005 for.
PCT IPER completed Sep. 3, 2003 for International Application No. PCT/US2002/09425.
PCT Written Opinion mailed May 28, 2003 for.
PCT Written Opinion mailed Nov. 24, 2005 for.
Sep. 1, 2004, Application No. 02 728 584.0-2221.

* cited by examiner

SCAN BASED CONFIGURATION CONTROL IN A GAMING ENVIRONMENT

RELATED APPLICATION DATA

This application is a divisional application, pursuant to the provisions of 35 U.S.C. §120, of prior U.S. patent application Ser. No. 11/207,079, titled "SCAN BASED CONFIGURATION CONTROL IN A GAMING ENVIRONMENT" by Fabbri et al., filed on Aug. 17, 2005, the entirety of which is incorporated herein by reference for all purposes.

BACKGROUND OF THE INVENTION

This invention relates to gaming machines such as slot machines and video poker machines. More particularly, the present invention relates to a technique for implementing scan based configuration control in a gaming environment.

Gaming machines are becoming increasingly sophisticated. Many slot and gaming machines now employ processor driven systems that receive input from touchscreens, output information on CRT video displays and printers, drive mechanized assemblies, and communicate with a host of internal devices and external networks. One complication that occurs as a result of this sophistication is that gaming machines are no longer available in a configuration that is considered "standard". Instead, owners are able to configure their gaming machines with unique sets of peripherals, modes of operation, methods for handling exceptions, etc., in order to satisfy their business needs and requirements of local gaming jurisdictions.

Traditionally, a variety of different techniques may be used for configuring conventional gaming machines. One such configuration technique is implemented by encoding configuration information into a chipset which is mounted on to the gaming machine motherboard or Master Gaming Controller. For example, according to one technique, a "Version Chip" EPROM may be programmed to store a predetermined four byte Version ID value in the EPROM's non-volatile memory. Once programmed, the Version Chip may then be mounted on to the gaming machine motherboard or Master Gaming Controller of the gaming machine. During initialization, the Master Gaming Controller reads the four-byte Version ID value stored in the Version Chip, and uses this value to establish various configuration parameters relating to gaming machine operations.

One advantage of using the above-described gaming machine configuration technique is that it helps to minimize or reduce the introduction of human error into the configuration process since, once the Version Chip has been programmed and installed in the gaming machine, the gaming machine is able to configure itself automatically without further human intervention. Another advantage of this technique is that it helps to minimize or reduce security risks associated with unauthorized tampering of the gaming machine configuration since the gaming machine configuration parameters are determined solely upon the Version ID information stored within the Version Chip.

Despite these advantages, however, the Version Chip gaming machine configuration technique also introduces a number of undesirable limitations to the gaming machine configuration process. For example, the implementing of changes to the gaming machine configuration parameters typically involves changing and/or reprogramming the Version Chip, which typically can only be performed by qualified technicians. Additionally, the current technique for authenticating a Version Chip typically involves a time-consuming process in which the Version Chip is physically removed from the gaming machine, inserted into a Version Chip authentication device, manually authenticated via the use of a predetermined hash algorithm and randomization seed, removed from the Version Chip authentication device, and reinserted into the gaming machine. Moreover, the conventional process of manually authenticating a Version Chip increases the risk of introducing human error into the authentication process since a human authenticator is typically required to perform the authentication testing, and to visually compare and verify the matching of the output data from the Version Chip authentication test to expected, predetermined data. The integrity of the data within the Version Chip can also be altered during the removal/installation of the chip from/to the processor tray during the manual authentication process due to electrostatic discharges from the human authenticator.

In light of the above, it will be appreciated that there exist a need for improving conventional techniques for configuring or reconfiguring gaming machines.

SUMMARY OF THE INVENTION

Various aspects of the present invention are directed to different methods, systems, and computer program products for facilitating configuration of a gaming machine. In at least one embodiment, configuration of the gaming machine may be effected via the use of a gaming machine configuration device. Additionally, in at least one embodiment, configuration of the gaming machine may be permitted only during specified operating modes of the gaming machine, such as, for example, while the gaming machine is in a configuration mode of operation. When the presence of a gaming machine configuration device is detected, configuration indicia stored on the configuration device may be accessed and used to determine at least one configuration parameter relating to configuration of the gaming machine. Configuration or reconfiguration of the gaming machine may then be implemented using the at least one configuration parameter. According to a specific embodiment, the gaming machine configuration device may correspond to a configuration ticket which can be inserted into the gaming machine bill validator module. When it is detected that the configuration ticket has been inserted into the bill validator module, the configuration indicia from the configuration ticket may be read and used to determine at least one configuration parameter relating to configuration of the gaming machine.

Additional aspects of the present invention are directed to different methods, systems, and computer program products for facilitating authentication testing of a component of a gaming machine. In at least one embodiment, authentication of the gaming machine component may be effected via the use of a gaming machine authentication device. Additionally, in at least one embodiment, authentication of the gaming machine component may be permitted only during specified operating modes of the gaming machine, such as, for example, while the gaming machine is in an authentication mode of operation. When the presence of a gaming machine authentication device is detected, authentication information stored on the authentication device may be accessed and used to generate authentication output data relating to the component being authenticated. The authentication output data may then be provided to an external entity for verifying the results of the authentication test. According to a specific embodiment, the gaming machine authentication device may correspond to an authentication ticket which can be inserted into the gaming machine bill validator module. When it is detected that the authentication ticket has been inserted into the bill validator module, the authentication information from the authentication ticket may be read and used to generate the authentication output data relating to the component being authenticated.

Additional objects, features and advantages of the various aspects of the present invention will become apparent from the following description of its preferred embodiments, which description should be taken in conjunction with the accompanying drawings.

DETAILED DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not obscure the present invention.

Gaming Machine

Figure 1:
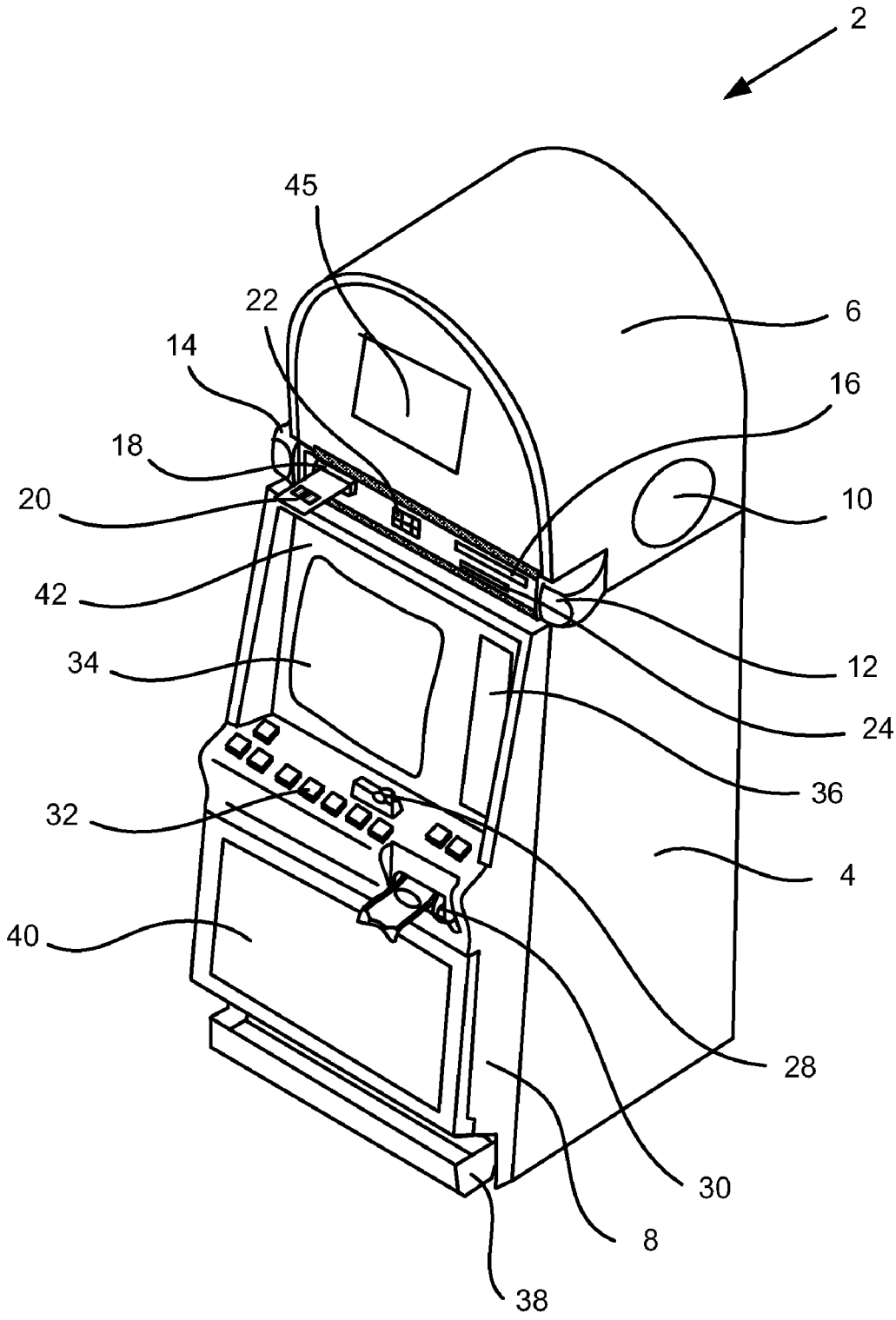
FIG. 1 shows a prospective view of an exemplary gaming machine 2 in accordance with a specific embodiment of the present invention.

FIG. 1 shows a prospective view of an exemplary gaming machine 2 in accordance with a specific embodiment of the present invention. As illustrated in the example of FIG. 1, machine 2 includes a main cabinet 4, which generally surrounds the machine interior (illustrated, for example, in FIG. 3) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. According to a specific embodiment, the devices may be controlled by code executed by a master gaming controller housed inside the main cabinet 4 of the machine 2. In specific embodiments where it may be required that the code be periodically configured and/or authenticated in a secure manner, the technique of the present invention may be used for accomplishing such tasks.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

As illustrated in the example of FIG. 1, the gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints barcoded tickets 20, a key pad 22 for entering player tracking information, a florescent display 16 for displaying player tracking information, a card reader 24 for entering a magnetic striped card containing player tracking information, and a video display screen 45. The ticket printer 18 may be used to print tickets for a cashless ticketing system. Further, the top box 6 may house different or additional devices not illustrated in FIG. 1. For example, the top box may include a bonus wheel or a back-lit silk screened panel which may be used to add bonus features to the game being played on the gaming machine. As another example, the top box may include a display for a progressive jackpot offered on the gaming machine. During a game, these devices are controlled and powered, in part, by circuitry (e.g. a master gaming controller) housed within the main cabinet 4 of the machine 2.

It will be appreciated that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer is normally used in International Game Technology (IGT) gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion. Further details of a state based gaming system, recovery from malfunctions and game history are described in U.S. Pat. No. 6,804,763, titled "High Performance Battery Backed RAM Interface", U.S. Pat. No. 6,863,608, titled "Frame Capture of Actual Game Play," U.S. application Ser. No. 10/243,104, titled, "Dynamic NV-RAM," and U.S. application Ser. No. 10/758,828, titled, "Frame Capture of Actual Game Play," each of which is incorporated by reference and for all purposes.

Another feature of gaming machines, such as IGT gaming computers, is that they often include unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming machine to a remote device. Often SAS is used in conjunction with a player tracking system.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices and/or trusted memory sources are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms included in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 from U.S. patent application Ser. No. 09/925,098, filed Aug. 8, 2001 and titled "Process Verification," which is incorporated herein in its entirety and for all purposes.

In at least one embodiment, at least a portion of the trusted memory devices/sources may correspond to memory which cannot easily be altered (unalterable memory) such as, for example, EPROMS, PROMS, Bios, Extended Bios, and/or other memory sources which are able to be configured, verified, and/or authenticated (e.g., for authenticity) in a secure and controlled manner.

According to a specific implementation, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment of the present invention, the remote device and the trusted information source may engage in methods using zero knowledge proofs to authenticate each of their respective identities. Details of zero knowledge proofs that may be used with the present invention are described in US publication no. 2003/0203756, by Jackson, filed on Apr. 25, 2002 and entitled, "Authentication in a Secure Computerized Gaming System, which is incorporated herein in its entirety and for all purposes.

Gaming devices storing trusted information may utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

Additional details relating to trusted memory devices/sources are described in U.S. patent application Ser. No. 11/078,966, entitled "SECURED VIRTUAL NETWORK IN A GAMING ENVIRONMENT", naming Nguyen et al. as inventors, filed on Mar. 10, 2005, herein incorporated in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 45 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 2:
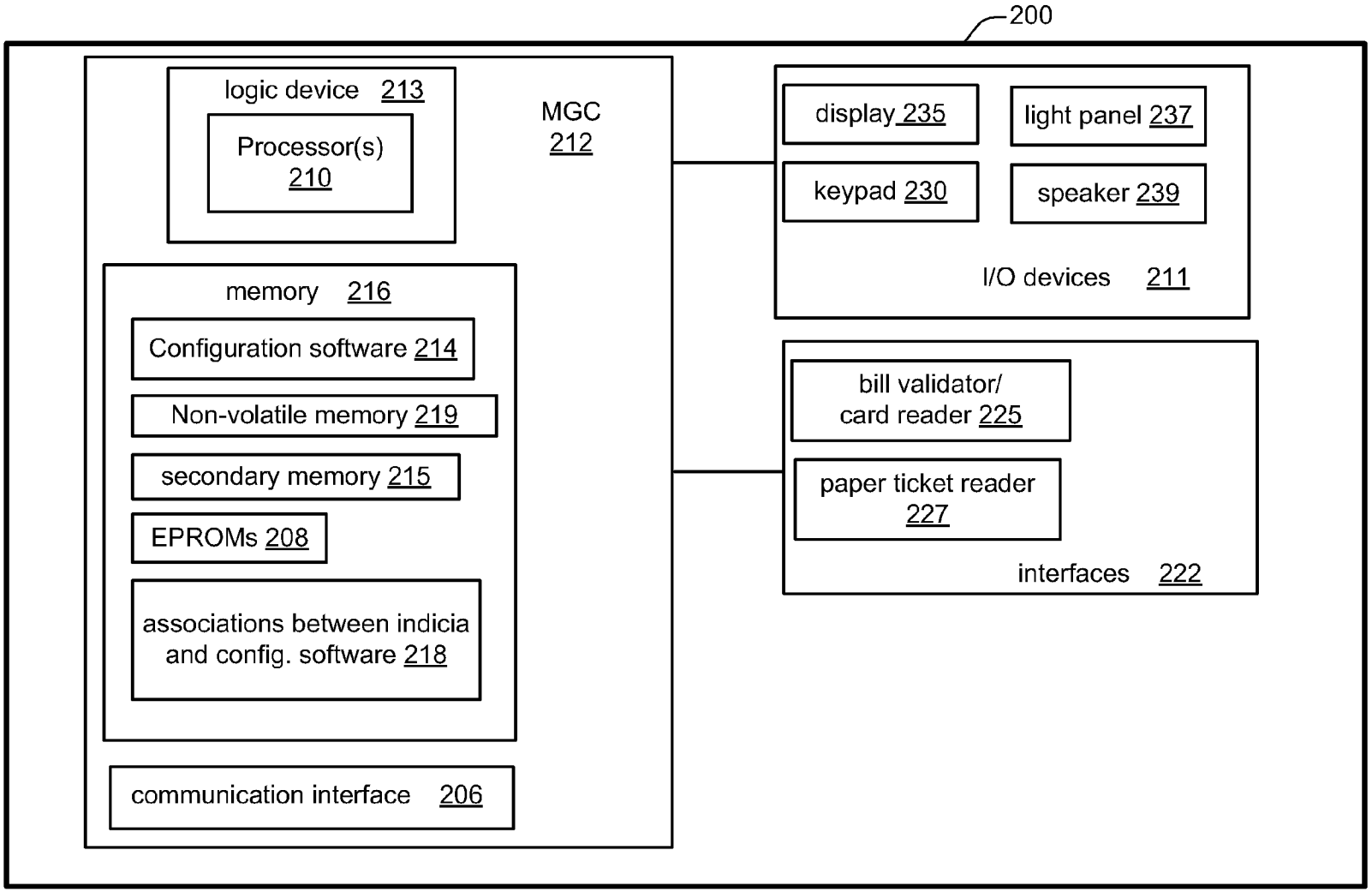
FIG. 2 is a simplified block diagram of an exemplary gaming machine 200 in accordance with a specific embodiment of the present invention.

FIG. 2 is a simplified block diagram of an exemplary gaming machine 200 in accordance with a specific embodiment of the present invention. As illustrated in the embodiment of FIG. 2, gaming machine 200 includes at least one processor 210, interfaces 222, and memory 216.

In one implementation, processor 210 and master gaming controller 212 are included in a logic device 213 enclosed in a logic device housing. The processor 210 may include any conventional processor or logic device configured to execute software allowing various configuration and reconfiguration tasks such as, for example: a) communicating with a remote source via communication interface 206, such as a server that stores authentication information or games; b) converting signals read by an interface to a format corresponding to that used by software or memory in the gaming machine; c) accessing memory to configure or reconfigure game parameters in the memory according to indicia read from the configuration device; d) communicating with interfaces 222 and various peripheral devices and I/O devices 211; e) operating interfaces 222 such as, for example, card reader 225 and paper ticket reader 227; f) operating and various peripheral devices such as, for example, display 235, key pad 230 and a light panel 216; etc. For instance, the processor 210 may send messages including configuration and reconfiguration information to the display 235 to inform casino personnel of configuration progress. As another example, the logic device 213 may send commands to the light panel 237 to display a particular light pattern and to the speaker 239 to project a sound to visually and aurally convey configuration information or progress. Light panel 237 and speaker 239 may also be used to communicate with authorized personnel for authentication and security purposes.

Interfaces 222 includes two configuration device interfaces: card reader 225 and bill validator/paper ticket reader 227. Card reader 225 and bill validator/paper ticket reader 227 may each comprise resources for handling and processing configuration indicia such as a microcontroller that converts voltage levels for one or more scanning devices to signals provided to processor 210. In one embodiment, application software for interfaces 222 stores instructions (such as, for example, how to read indicia from a portable configuration device) in a memory device such as, for example, non-volatile memory, hard drive or a flash memory.

The gaming machine 200 also includes memory 216 configured or designed to store, for example: 1) configuration software 214 such as all the parameters and settings for a game playable on the gaming machine; 2) associations 218 between configuration indicia read from a configuration device with one or more parameters and settings; 3) communication protocols allowing the processor 210 to communicate with interfaces 222 and I/O devices 211; 4) a secondary memory storage device 215 such as a non-volatile memory device, configured to store gaming software related information (the gaming software related information and memory may be used to store various audio files and games not currently being used and invoked in a configuration or reconfiguration); 5) communication transport protocols (such as, for example, TCP/IP, USB, Firewire, IEEE1394, Bluetooth, IEEE 802.11x (IEEE 802.11 standards), hiperlan/2, HomeRF, etc.) for allowing the gaming machine to communicate with local and non-local devices using such protocols; etc. Typically, the master gaming controller 212 communicates using a serial communication protocol. A few examples of serial communication protocols that may be used to communicate with the master gaming controller include but are not limited to USB, RS-232 and Netplex (a proprietary protocol developed by IGT, Reno, Nev.).

A plurality of device drivers may be stored in memory 216. For example, device drivers for different types of card readers, bill validators, displays, and key pads may all be stored in the memory 216. When one type of a particular peripheral device is exchanged for another type of the particular device, a new device driver may be loaded from the memory 216 by the processor 210 to allow communication with the device. For instance, one type of card reader in gaming machine 200 may be replaced with a second type of card reader where device drivers for both card readers are stored in the memory 216.

In some embodiments, the software units stored in the memory 216 may be upgraded as needed. For instance, when the memory 216 is a hard drive, new games, game options, various new parameters, new settings for existing parameters, new settings for new parameters, device drivers, and new communication protocols may be uploaded to the memory from the master gaming controller 104 or from some other external device. As another example, when the memory 216 includes a CD/DVD drive including a CD/DVD designed or configured to store game options, parameters, and settings, the software stored in the memory may be upgraded by replacing a first CD/DVD with a second CD/DVD. In yet another example, when the memory 216 uses one or more flash memory 219 or EPROM 208 units designed or configured to store games, game options, parameters, settings, the software stored in the flash and/or EPROM memory units may be upgraded by replacing one or more memory units with new memory units which include the upgraded software. In another embodiment, one or more of the memory devices, such as the hard-drive, may be employed in a game software download process from a remote software server.

It will be apparent to those skilled in the art that other memory types, including various computer readable media, may be used for storing and executing program instructions pertaining to the operation of the present invention. Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files including higher level code that may be executed by the computer using an interpreter.

Having briefly discussed an exemplary gaming machine suitable for use with of the present invention, the configuration and reconfiguration aspects of the invention will now be discussed. As mentioned earlier, the present invention implements a complementary gaming machine configuration device and interface operably associated with the gaming machine to facilitate automated configuration and reconfiguration of game parameters. In one aspect, the present invention relates to a gaming machine that comprises automated and scan-based configuration/reconfiguration capability for games playable on the machine. An interface included in the gaming machine, or operably associated with the gaming machine, reads configuration indicia provided on a gaming machine configuration device. In one embodiment, the configuration device is a configuration ticket or printed ticket and the configuration indicia are printed or marked on the ticket. For example, a printer may manufacture the ticket with the settings for each parameter determined via computer input to a computer associated with the printer, or individuals may manually check boxes designating each setting for a configuration ticket that has options for each parameter. Alternately, configuration indicia may be placed on a ticket via a number or other identifier that is used to access data specifically designating which parameters are changed and to what settings.

According to a specific embodiment, a module that manages a gaming machine (e.g., Master Gaming Controller or MGC 212) converts the indicia provided on the configuration device to commands or parameters that either directly or indirectly affect the appropriate portions of the gaming machine. Using the direct approach, the indicia can be uniquely correlated to a particular set of configuration changes. Alternatively, using an indirect approach, the indicia serves as a reference or identifier that is used to locate the desired collection of configuration changes. This collection may be stored internally (within the game) or externally (accessible via a communications link such as an Ethernet connection, for example). For example, in one implementation the configuration device may include configuration indicia such as, for example, Version ID information and/or other jurisdictional information which typically would be stored in a Version Chip.

According to different embodiments of the present invention, a variety of different mechanisms may be used to provide the desired configuration information to the gaming machine. For example, as stated previously, in one embodiment, the configuration device is a configuration ticket or printed ticket which includes configuration information. In order to read the information from the configuration ticket, the bill of validator module of gaming machine may be adapted to read the information on the configuration ticket during certain modes of operation. Alternatively, the gaming machine and may include a separate scanning device such as, for example, a barcode scanner for reading the information on the configuration ticket. In other embodiments, the configuration device may be implemented using other conventional technology for communicating with the gamming machine such as, for example, WiFi technology, radio frequency (RF) technology, magnetic technology, optical technology, etc. In such other embodiments, the gaming machine may be adapted to include hardware and/or software for receiving communications, signals, or other information from the configuration device.

Additionally, in at least one embodiment of the present invention, configuration of the gaming machine may be permitted only at times when the gaming machine is operating in specific modes of operation such as, for example, configuration mode, operator mode, etc. Thus, for example, according to one implementation, the gaming machine may be configured or designed to receive input from the configuration device while the gaming machine is in the configuration mode of operation. However, when the gaming machine is not operating in configuration mode, input from the configuration device may be rejected or ignored.

Figure 4:
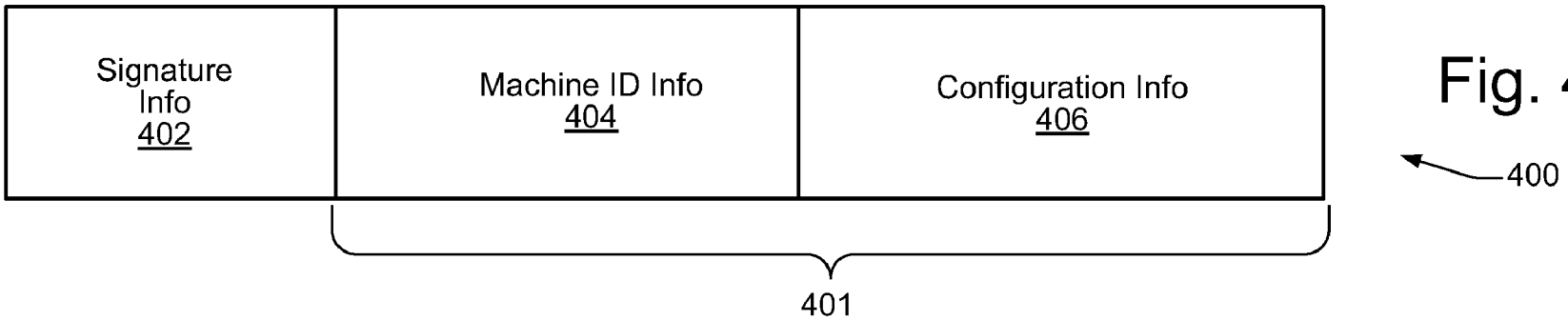
FIG. 4 illustrates an example of a specific embodiment of a configuration device 400 which may be used for implementing various aspects of the present invention.

FIG. 4 illustrates an example of a specific embodiment of a configuration device 400 which may be used for implementing various aspects of the present invention. As illustrated in the example of FIG. 4, configuration device 400 is implemented as a configuration ticket which may include a variety of information encoded therein such as, for example, configuration information 406; machine ID information 404; encryption signature information 402; etc.

According to one embodiment, the configuration ticket may be designed as a single-use configuration ticket which may only be used once to configure a selected gaming machine. Once the configuration ticket has been used to configure the selected gaming machine, the ticket may be invalidated using a variety of different mechanisms in order to prevent the configuration ticket from being reused. Additionally, in one implementation, the gaming machine may be adapted to keep and store the configuration ticket within the gaming machine body. In an alternate embodiment, the configuration ticket may be used to configure multiple gaming machines. In such an embodiment, the gaming machines may be adapted to read the configuration ticket information, and then eject the configuration ticket so that it can be used to configure additional gaming machines.

Referring to FIG. 4, according to a least one implementation, the configuration information 406 portion of the configuration ticket may include configuration indicia such as, for example, a Version ID value and/or other Version ID information, which may be used be used to determine and/or retrieve desired configuration parameters for the selected gaming machine being configured. Such gaming parameters may include, for example: country code parameters; default limits parameters (e.g., bill limits, voucher limits, credit limits, etc.); accounting model parameters; operating model parameters; communication protocol parameters; default display parameters; default button assignment parameters; etc. Additional configurable gaming parameters include: language parameters; sound parameters; attract mode parameters; bill acceptor parameters; coin acceptor parameters; hopper parameters; printer parameters; credit limit parameters; hopper limit parameters; jackpot limit parameters; bill limit parameters; partial pay limit parameters; printer pay limit parameters; W2G limit parameters; coin acceptor limit parameters; voucher redemption limit parameters; progressive spectrum display parameters; display parameters; credit mode parameters; game speed parameters; pay speed parameters; bill tilt mode parameters; printer tilt mode parameters; host cashless controller parameters; machine type parameters; host system bonus parameters; candle parameters; machine serial number parameters; machine asset number parameters; voucher validation parameters; WAP protocol parameters; coinless mode parameters; cashless transfer parameters; change voucher parameters; quick tip parameters; Bios parameters; etc.

According to a specific embodiment, the gaming machine may be configured or designed to operate in attract mode when the machine is idle and no money (or indicia or credit) has been deposited on the machine. Idle mode identifies a machine state where the machine is not being played by a patron or used by an attendant, and is ready for game play. During attract mode, the machine may randomly play sounds and/or show video clips of actual game play to attract customers. Example of attract mode parameters are: duration, sound volume, frequency (i.e. show the attract every 30 seconds, 2 minutes etc.); etc.

In addition to configuring the gaming machine hardware/software, the configuration device of the present invention may also be used to configure peripheral devices associated with the gaming machine such as, for example, the bill validator module, coin hopper, etc.

According to a specific embodiment, the configuration information 406 may be mapped to a predetermined set of configuration parameters which are stored within local memory of the gaming machine. In one implementation, one or more tables of configuration parameters may be populated and stored within non-volatile memory of the gaming machine. Additionally, in at least one implementation, selected information stored within the tables of the gaming machine may be automatically updated, modified, and/or populated via a remote gaming server.

In another embodiment, the information provided by the configuration device 400 may be used to trigger remote programming/configuration of the gaming machine via a remote game server or remote host. For example, in one implementation, the gaming machine may be configured or designed to allow a remote host to remotely program or reprogram the gaming machine firmware based, for example, on the information provided by the configuration device 400.

In the yet another embodiment, multiple, separate configuration tickets may be used to configure or reconfigure desired configuration parameters. For example, a first configuration ticket may be used to configure default display parameters, while a second configuration ticket may be used to configure default button assignment parameters.

According to different embodiments, the machine ID information 404 may include information for uniquely identifying the gaming machine (or machines) which is to be configured or reconfigured. In this way, the machine ID information helps to reduce the possibility of configuration tickets being used to configure the wrong gaming machine. Example of different types of machine ID information may include: the machine processor tray (PCB) ID; the machine serial number (which, for example, may be hard coded in the machine or in the MGC module); a unique value or identifier assigned by the casino; etc. According to one implementation, before the configuration ticket may be used for configuring a selected gaming machine, the machine ID information 404 of the configuration ticket is compared to the corresponding ID information of the selected gaming machine. If a valid match is not detected, the configuration ticket is rejected without performing any configuration operations.

It will be appreciated that, where desirable, the machine ID information portion of the configuration ticket may be omitted in specific implementations. However, omission of the machine ID information in such implementations increases the possibility of such configuration tickets being used to configure the wrong gaming machine.

In order to provide for increased security with respect to authorized gaming machine configuration operations, portions of the configuration information 406 and/or portions of the machine ID information 404 may be encrypted. For example, in at least one embodiment, encryption architectures may employ asymmetric and symmetric encryption techniques.

In symmetric encryption, two parties share a common encryption key that is used to encrypt to encrypt and to decrypt information. To maintain security, the symmetric key should preferably remain a secret shared only be the two parties using the key. In an asymmetric encryption scheme, a public-private encryption key pair is generated. Information encrypted with the private encryption key may be decrypted only using the corresponding public encryption key of the public-private encryption key pair and information encrypted with the public encryption key may be decrypted only using the private encryption key of the public-private encryption key pair. Thus, an entity with a private encryption key of public-private encryption key pair may give its public encryption key to many other entities. The public key may be made available (e.g., via an Internet server, e-mail, or some other means) to whoever needs or wants it. The private key, on the other hand, is not made public. In this way, interested parties may use the public encryption key to encrypt the data. However, as long as the private encryption key remains private, only the entity (or entities) with the private encryption key can decrypt information encrypted with the public encryption key.

A private key of a public-private key pair may also be used to sign a message or other information, and the signature may then be used for authenticating the signed information. Thus, for example, when a private key is used to sign a portion of encrypted information, the public key may be used to validate the signature and therefore the authenticity of the encrypted information. Additional information relating to encryption techniques is provided in U.S. Pat. No. 6,866,586 which is incorporated herein by reference in its entirety for all purposes.

According to one implementation, portion 401 of the configuration device 400 (which includes, for example, all or portions of the machine ID information 404 and configuration information 406) may be encrypted using a private encryption key. Additionally, the encrypted portion 401 of the configuration ticket may be signed using a private key, and the signature included in the encryption signature information 402 portion of the configuration ticket. Before the configuration ticket may be used for configuring a selected gaming machine, the configuration ticket may be authenticated or validated, for example, by using a public key to validate the encryption signature information portion 402 of the configuration ticket. If the signature can not be validated, the configuration ticket is rejected without performing any configuration operations. According to specific embodiments, where desirable, the encryption signature information 402 portion of the configuration ticket may be omitted.

Figure 6:
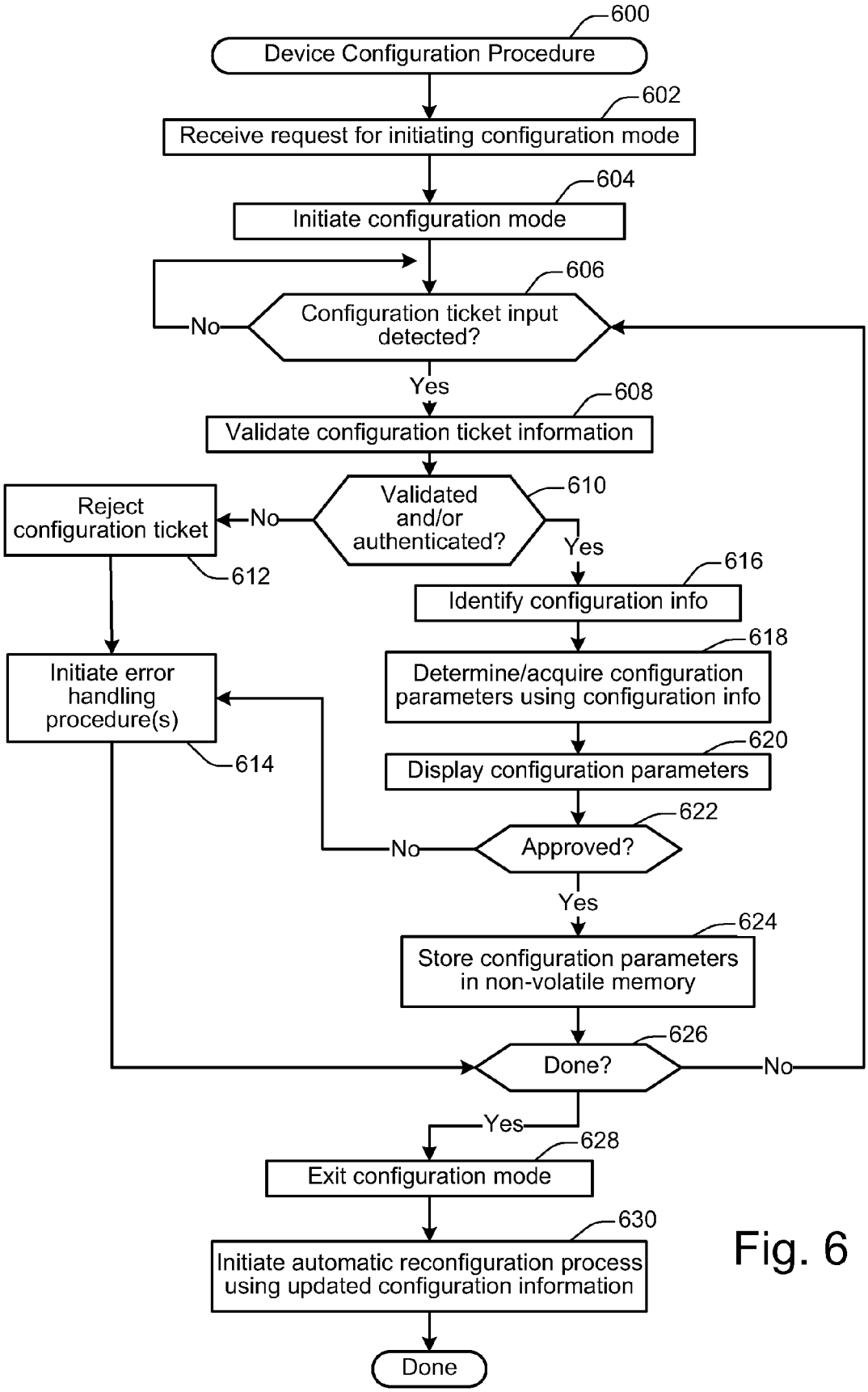
FIG. 6 shows a flow diagram of a Device Configuration Procedure 600 in accordance with a specific embodiment of the present invention.

FIG. 6 shows a flow diagram of a Device Configuration Procedure 600 in accordance with a specific embodiment of the present invention. In at least one implementation, the Device Configuration Procedure 600 may be implemented by hardware and/or software components of a gaming device which has been selected for configuration. In a specific implementation, the Device Configuration Procedure 600 may be implemented at the Master Gaming Controller (MGC) 212.

Initially, as shown at 602 the gaming device receives a request for initiating a configuration mode of operation. Such a request may be generated, for example, in response to input from a human operator, a remote device, or from the configuration device itself. In response, the gaming machine may switch its current operating mode to initiate (604) a configuration mode of operation. According to a specific implementation, while in the configuration mode of operation, the bill validator module (e.g., 225) may be configured or designed to read and extract information from configuration tickets which are input into the bill validator module. For example, the configuration ticket may include a barcode representing at least a portion of the configuration ticket information described in FIG. 4. According to a specific implementation, the bill validator module may be configured or designed to read the barcode and securely transmit the barcode information to the Master Gaming Controller. The Master Gaming Controller may then decode the barcode information, and use the decoded information to perform subsequent configuration operations.

According to one implementation, the gaming machine may be configured or designed to receive input from the configuration device only while the gaming machine is in the configuration mode of operation. When the gaming machine is not operating in configuration mode, input from the configuration device may be rejected or ignored. This feature provides an additional security measure to prevent unauthorized persons (e.g., players) from tampering with the gaming machine configuration parameters.

Upon detection (606) of a configuration ticket input, the identified configuration ticket is validated and/or authenticated (608). According to a specific embodiment, the process of validating specific information may include analyzing the information to determine whether the content and/or format of the information conforms with specific criteria. Additionally, the process of authenticating specific information may include analyzing the information to determine whether such information originated from an approved source and/or whether such information conforms with other specific criteria used to verify the authenticity of the information.

Validation/authentication of a configuration ticket may be performed using a variety of mechanisms. For example, in one embodiment, information from the configuration ticket may be read and sent to a remote server for authentication/validation. The remote server may then perform any necessary authentication/validation operations, and provide a response indicating whether or not the identified configuration ticket has been authenticated/validated. For auditing purposes, information relating to the identity of the gaming machine, identity of the configuration ticket, and/or other desired information (e.g., timestamp information, information relating to the identity of the technician performing the configuration, etc.) may be recorded, for example, by logging such information in the memory of the gaming machine, by logging such information in the memory of the remote server, and/or by printing a ticket including such information using the ticket printer module (e.g., 18) of the gaming machine.

In an alternate embodiment, the gaming machine may be configured or designed to validate or authenticate the identified configuration ticket. According to one implementation, the ticket authentication may include applying a CRC algorithm to all or portions of the information 401 of the configuration ticket, and comparing the result with the signature information of portion 402. If both values are equal (or if it is determined that there is a match), it may be assumed that the ticket is valid. Accordingly, configuration information 406 may then be used to configure the gaming machine. In one implementation where the configuration ticket includes encryption signature information, the configuration ticket may be authenticated or validated, for example, by using a public key to authenticate the encryption signature information portion 402 of the configuration ticket. If the signature can not be authenticated, the configuration ticket is rejected (612), and an error handling procedure may be initiated (614).

Additionally, according to a specific implementation, validation/authentication of the configuration ticket may include matching the machine ID information 404 of the configuration ticket with the machine ID information of the selected gaming machine. If a valid match is not detected, the configuration ticket is rejected (612), and an error handling procedure may be initiated (614).

Assuming that the configuration ticket has been validated/authenticated, the configuration information provided on the configuration ticket is identified (616), and used to determine and/or acquire one or more associated configuration parameters. According to one embodiment, the configuration information 406 may be mapped to a predetermined set of configuration parameters which are stored within local memory of the gaming machine. For example, in one implementation, the configuration information 406 may include a Version ID value similar to that provided by a conventional Version Chip. This Version ID value may then be used by the MGC to determine the appropriate configuration parameters to be implemented. In at least one implementation, the configuration parameters may be selected from one or more tables of configuration parameters stored within non-volatile memory of the gaming machine. Additionally, in at least one implementation, selected information stored within the tables of the gaming machine may be automatically updated, modified, and/or populated via a remote gaming server.

In another embodiment, the information provided by the configuration device 400 may be used to acquire or retrieve configuration parameters from a remote device such as, for example, a remote game server or remote host. Additionally, in one implementation, the gaming machine may be configured or designed to allow a remote host to remotely configure the gaming machine based, for example, on the information provided by the identified configuration ticket.

It is also possible for the configuration ticket to specify one or more configuration parameters which are to be implemented at the selected gaming machine. In a specific implementation, multiple configuration tickets may be used to configure or reconfigure desired configuration parameters of the gaming machine.

Once the desired configuration parameters have been determined/acquired, the identified configuration parameters may be displayed (620) (e.g., on the gaming machine display) for approval (622) before being implemented. In one implementation, a service technician or operator may be required to approve the new configuration parameters before they are implemented at the selected gaming machine. Such approval may be implemented, for example, by the technician or operator depressing a specified button on the gaming machine to indicate approval. In addition to operator approval, the configuration parameters may also be required to be approved by other entities such as, for example, the MCG 212, a remote server, etc. If the identified configuration parameters are not approved, an appropriate error handling procedure may be initiated (614). If the identified configuration parameters are approved, then the approved configuration parameters may be stored (624) in non-volatile memory before being implemented.

As shown at 626, a determination is made as to whether there are additional configuration operations to be performed. For example, while in configuration mode, the gaming machine may wait for additional configuration tickets to be input.

After all the desired configuration parameters have been selected, the gaming machine may exit (628) the configuration mode of operation, whereupon an automatic reconfiguration process may then be initiated (630) in order to update the configuration information at the selected gaming machine with the selected configuration parameters. If desired, a receipt or record of the configuration changes may be printed (e.g., by the ticket printer 18) for audit purposes.

It will be appreciated that the configuration technique of the present invention provides a number of advantages over conventional gaming machine configuration techniques. For example one advantage of the configuration technique of the present invention is that it helps to minimize or reduce the introduction of human error into the configuration process since, for example, the configuration parameters may be automatically determined and selected using information provided by the configuration ticket(s). Additionally, the technique of the present invention may be implemented in gaming machines which do not include Version Chip components. Moreover, the technique of the present invention may help to reduce gaming machine manufacturing costs by eliminating the necessity for including Version Chips and/or other configuration hardware (e.g., EPROMs) in gaming machines. This also helps to reduce the amount of time a gaming machine is placed in configuration mode since, for example, the replacement of a configuration EPROM or Version Chip requires more time for implementing than the insertion of a configuration ticket. Additionally, the changing and programming of a Version Chip typically requires the assistance of a qualified technician, whereas the insertion of a configuration ticket may be performed by a non-qualified technician such as, for example, a casino attendant. Another advantage of the technique of the present invention is that it is configurable to enable off-line configuration of gaming machines and/or online (e.g., server based) configuration of gaming machines.

In at least one embodiment of the present invention, the technique of the present invention may also be used to configure various in game modes and/or game parameters of selected gaming machines.

Figure 8:
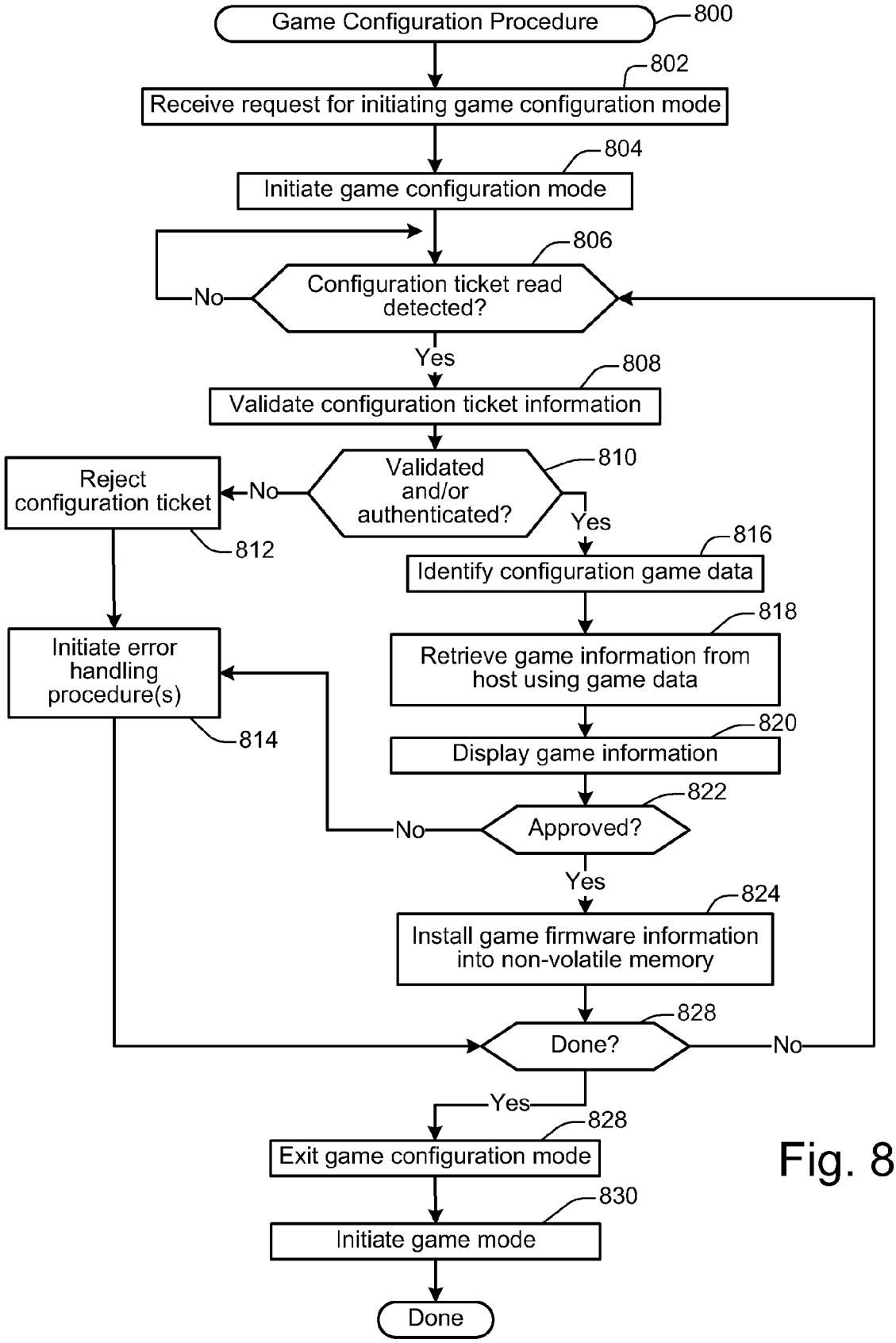
FIG. 8 shows a flow diagram of a Game Configuration Procedure 800 in accordance with a specific embodiment of the present invention.

FIG. 8 shows a flow diagram of a Game Configuration Procedure 800 in accordance with a specific embodiment of the present invention. In at least one implementation, the Game Configuration Procedure 800 may be implemented by hardware and/or software components of a gaming device which has been selected for configuration. In a specific implementation, the Game Configuration Procedure 800 may be implemented at the Master Gaming Controller (MGC) 212.

It is noted that many of the operations in the Game Configuration Procedure flow diagram of FIG. 8 are similar to the operations described previously with respect to the device configuration procedure 600 of Figure six, and therefore will be described in greater detail.

Initially, as shown at 802 the gaming device receives a request for initiating a game configuration mode of operation. Such a request may be generated, for example, in response to input from a human operator or a remote device. In response, the gaming machine may switch its current operating mode to initiate (804) a game configuration mode of operation. According to a specific implementation, while in the game configuration mode of operation, the bill validator module (e.g., 225) may be configured or designed to read and extract information from game configuration tickets which are input into the bill validator module.

According to one implementation, the gaming machine may be configured or designed to receive input from the game configuration tickets only while the gaming machine is in the game configuration mode of operation. When the gaming machine is not operating in the game configuration mode, input from the configuration device may be rejected or ignored. This feature provides an additional security measure to prevent unauthorized persons (e.g., players) from tampering with the gaming machine configuration parameters.

Figure 3:
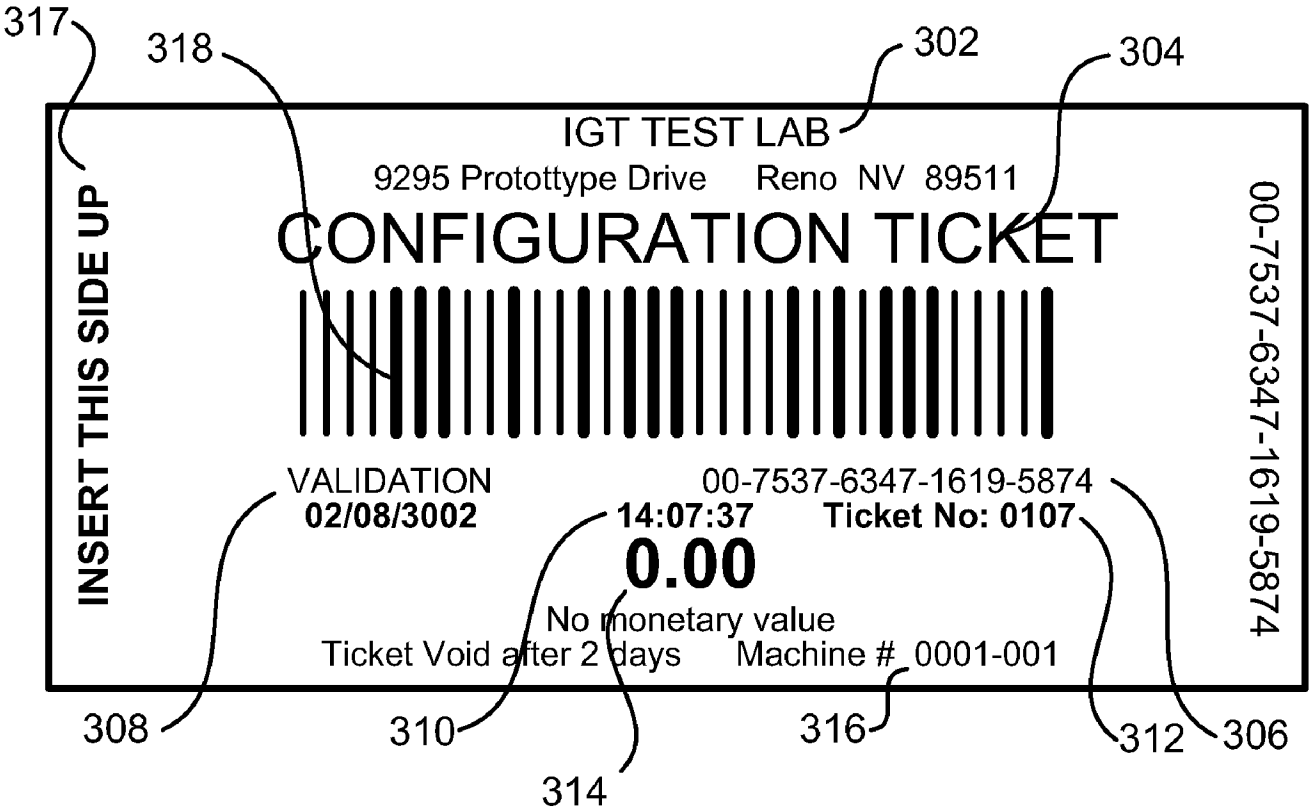
FIG. 3 illustrates an example of a portable configuration or authentication ticket 300 in accordance with specific embodiment of the present invention.

In at least one implementation, the game configuration ticket may include information and features similar to those described with respect to configuration device 400 of FIG. 4 and configuration ticket 300 of FIG. 3. Additionally, the game configuration ticket may also include game configuration parameters such as, for example: information relating to one or more desired game(s) which the gaming machine is to implement while in game play mode during specified time periods; denominations of the games (e.g., in a multidenomination gaming machine); maximum bet allowed; the maximum of number of lines allowed in a multi-line game; etc.

Upon detection (808) of a game configuration ticket input, the identified game configuration ticket is validated and/or authenticated (808). Validation/authentication of a game configuration ticket may be performed using a variety of mechanisms such as those described previously, for example, with respect to FIG. 6. If it is determined (810) that the validation and/or authentication of the game configuration ticket has failed, the game configuration ticket is rejected (812), and an error handling procedure may be initiated (814).

Assuming that the game configuration ticket has been validated and/or authenticated (810), the game configuration information provided on the game configuration ticket is identified (816), and used to determine and/or acquire one or more associated configuration parameters. According to one embodiment, the game configuration information 408 may be mapped to a predetermined set of game configuration parameters which are stored within local memory of the gaming machine. In another embodiment, the information provided by the game configuration device 400 may be used to acquire or retrieve configuration parameters from a remote device such as, for example, a remote game server or remote host. Additionally, in one implementation, the gaming machine may be configured or designed to allow a remote host to remotely configure the gaming machine based, for example, on the information provided by the identified game configuration ticket. For example, in specific jurisdictions which require that gaming machines use a proprietary processor running instructions to generate a game of chance from an EPROM or other form of non-volatile memory, the game configuration information provided by the game configuration ticket may be used to retrieve (818) game information such as, for example, game code, game firmware/software information, and/or other game parameters from a remote host to be subsequently installed in the appropriate firmware and/or other non-volatile memory of the gaming machine. In at least one implementation, the retrieved game parameters may first be displayed on the gaming machine display for approval before installation in the gaming machine memory. Assuming that the retrieved game parameters are approved (822), the retrieved game information may then be installed (824) in the appropriate memory locations (e.g., firmware and/or other non-volatile memory sources) of the gaming machine.

Once the desired game information has been installed at the gaming machine, the gaming machine may exit (828) the game configuration mode of operation, whereupon the game play mode may be initiated using the newly installed game information.

Authentication

In addition to being utilized for configuration of the gaming machines, the technique of the present invention may also be used for performing authentication of the gaming machine hardware/software components (such as, for example, game code residing in the gaming machine firmware), peripherals, and/or trusted memory sources.

As described previously, a common technique for authenticating a Version Chip which has been installed in a gaming machine involves a time-consuming process in which the gaming machine is taken off line, and the Version Chip physically removed from the gaming machine and inserted into a Version Chip authentication device.

The code programmed into the Version Chip is then manually authenticated (by a human authenticator, such as a gaming regulator) by using a predetermined hash algorithm and predetermined randomization seed to generate a hash code or checksum value for the code. The seed value is typically entered manually by the authenticator. The human authenticator then compares this hash code value with an expected, predetermined value to verify that there is a match. The comparison may also be performed using software which is able to communicate with the EPROM reader. The human authenticator verifies that the software reports a successful comparison. Once authenticated, the Version Chip is then removed from the Version Chip authentication device, reinserted into the gaming machine, and the gaming machine re-booted.

A similar process may also occur during jackpot verification. For example, when a player wins a large jackpot on a particular gaming machine, it is common practice for the casino to authenticate the game code of that gaming machine before delivering the jackpot payout to the player. Typically, the authentication of the game code involves removing game code firmware (e.g., an EPROM) from the gaming machine, and authenticating the game code using an external authentication testing device.

Additionally, it is noted that the removal of the Version Chip or other firmware from a gaming machine typically can only be performed by a qualified technician. Moreover, the removal of such devices involves the disarming of a number of security measures such as, for example, the unlocking and opening of the main gamming machine door; the unlocking and opening of the CPU door; the disarming any alarms which may be activated; etc. The disarming of such security measures increases the risk of unauthorized tampering of the gaming machine hardware/software.

Another problem associated with the conventional process of manually authenticating a Version Chip or other firmware is that a human authenticator is typically required to perform the authentication testing, which may involve manually inputting data, and visually comparing and verifying the matching of output data from the authentication test to expected, predetermined data. Because humans are used to perform conventional gaming machine authentication testing, conventional authentication techniques introduce increased risks of human error into the authentication process.

Another problem associated with the conventional process is that the integrity of the data within the Version Chip can also be altered or damaged during the removal/installation of the chip from/to the processor tray during the manual authentication process due to electrostatic discharges from the human authenticator.

As described in greater detail below, at least one embodiment of the present invention may include a gaming machine authentication technique which utilizes an authentication device (such as, for example, an authentication ticket) for performing at least a portion of authentication operations relating to the authenticating of gaming machine hardware components, software components, peripheral devices, and/or trusted memory sources. According to at least one embodiment, the authentication device may be configured or designed to perform authentication testing operations, or may be configured or designed to provide authentication test instructions to the gaming machine. The gaming machine may be configured or designed to receive the authentication test instructions from the authentication device, perform authentication test operations on specific components using the authentication test instructions, and output and/or display results from the authentication test operations.

Figure 5:
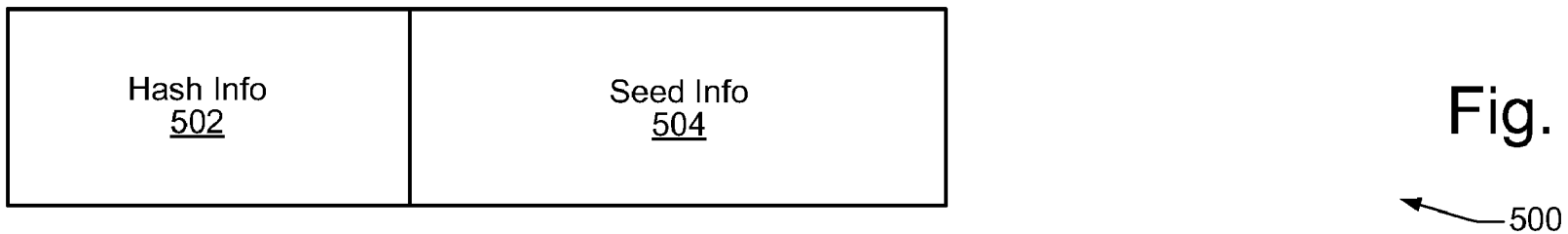
FIG. 5 illustrates an example of a specific embodiment of an authentication device 500 which may be used for implementing various aspects of the present invention.

FIG. 5 illustrates an example of a specific embodiment of an authentication device 500 which may be used for implementing various aspects of the present invention. As illustrated in the example of FIG. 5, the authentication device is implemented as an authentication ticket which may include a variety of information encoded therein such as, for example, hash algorithm information 502; seed information 504; encryption key information; etc. According to a specific implementation, the hash algorithm information 502 may include information relating to the type of hash algorithm (e.g., MD5, SHA, etc.) to be used for performing the authentication test(s). The seed information 504 may include, for example, a predetermined or randomized seed value to be used as part of the input parameters of the authentication test(s) being performed. Use of a seed value as an input parameter of a hash algorithm affects the outcome of the hash algorithm. One of the advantages of using a seed as part of the hash algorithm input parameters is that it provides a mechanism for masking or obscuring the actual hash value of the component (e.g., game code) being analyzed, thereby providing an additional measure of security.

In specific implementations where the specified hash algorithm requires additional input information (such as, for example, encryption key information), such additional input information may also be included as part of the information printed, stored and/or encoded onto the authentication device 500.

Figure 7:
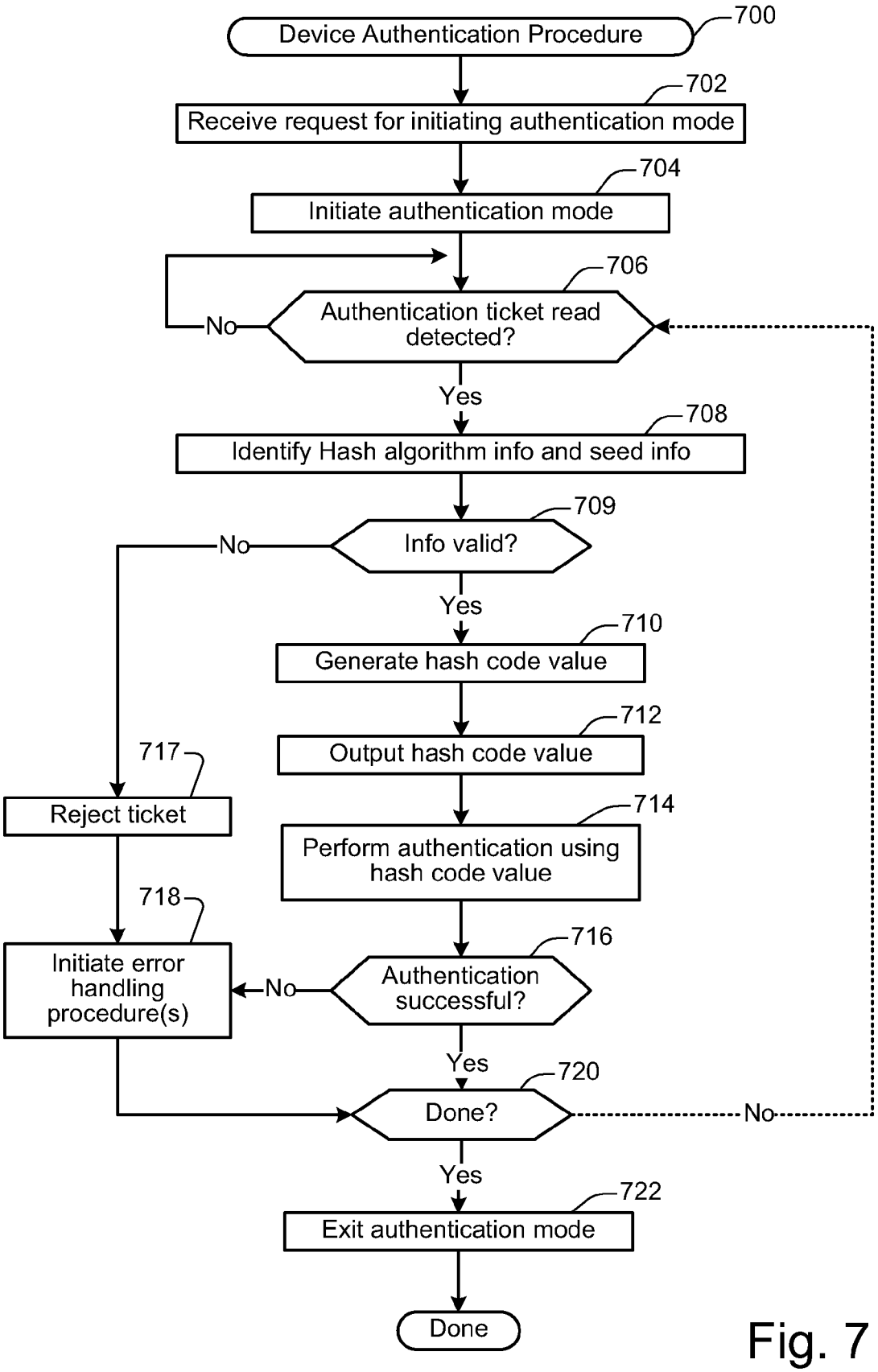
FIG. 7 shows a flow diagram of a Device Authentication Procedure 700 in accordance with a specific embodiment of the present invention.

FIG. 7 shows a flow diagram of a Device Authentication Procedure 700 in accordance with a specific embodiment of the present invention. In at least one implementation, the Device Authentication Procedure 700 may be implemented by hardware and/or software components of a gaming device which has been selected for authentication testing. In a specific implementation, the Device Authentication Procedure 700 may be implemented at the Master Gaming Controller (MGC) 212.

Initially, as shown at 702 the gaming device receives a request for initiating an authentication mode of operation. Such a request may be generated, for example, in response to input from a human operator or a remote device. In response, the gaming machine may switch its current operating mode to initiate (704) an authentication mode of operation. According to a specific implementation, while in the authentication mode of operation, the bill validator module (e.g., 225) may be configured or designed to read and extract information from authentication tickets which are input into the bill validator module. For example, the authentication ticket may include a barcode representing at least a portion of the authentication ticket information described, for example, in FIG. 5. According to a specific implementation, the bill validator module may be configured or designed to read the barcode and securely transmit the barcode information to the Master Gaming Controller. The Master Gaming Controller may then decode the barcode information, and use the decoded information to perform subsequent authentication operations.

Thus, for example, upon detection (706) of an authentication ticket input, the authentication information (e.g., hash algorithm information 502, seed information 504, etc.) provided on the authentication ticket is identified (708), and checked for validity (709). If it is determined that a portion of the authentication information is invalid, the authentication ticket is rejected (717), and an appropriate error handling procedure may be initiated (718).

Assuming that the identified authentication information is valid, the authentication information is used to generate (712) or compute appropriate output data. For example, for purposes of illustration, it will be assumed that the game code firmware of the gaming machine is to be authenticated, and that the hash algorithm information 502 specifies that an MD5 hash algorithm is to be used, and that the seed information 504 specifies a 12 digit randomized seed value to be used as part of the hash algorithm input parameters. The gaming machine may then compute an output hash code value of the game code using the specified hash algorithm and seed input parameters. The output hash code value may then be output (712) from the gaming machine using one or more output techniques such as, for example, displaying the output hash code value on the gaming machine display; printing an authentication output ticket which includes information relating to the output hash code value; electronically transmitting information relating to the output hash code value to an external device (such as, for example, a remote server, mobile authentication device, etc.); or some combination thereof.

Thus, for example, In a specific implementation where the output code hash value is displayed on the gaming machine display, a regulator performing the authentication test may visually compare the displayed output hash code value with an expected predetermined value in order to verify authentication (714) of the game code.

Additionally, or in another implementation, the output hash code value may be printed on an authentication output ticket (using, for example, ticket printer 18) in barcode format. The regulator may then use a mobile authentication verifying device (e.g., a specially configured laptop with a barcode scanner) to read the authentication output ticket data, and automatically compare the output hash code value with a predetermined value in order to verify authentication (714). One advantage of this implementation is that it is helpful in reducing errors introduced by humans since, for example, the authenticator or regulator is not required to manually input the output hash code value into the authentication verifying device, nor is the authenticator or regulator required to perform the comparison of the output hash code value with the predetermined value. Another advantage of this implementation is that the output authentication ticket may be used as a physical record which may be subsequently saved as part of the audit history of that gaming machine.

In yet another implementation, the output hash code value may be electronically transmitted (e.g., using wired or wireless technology) to an external device such as, for example, a remote server, mobile authentication verifying device, etc. The external device may then automatically compare the output hash code value with a predetermined value in order to verify authentication (714). According to a specific embodiment, the results of the comparison may be displayed to the authenticator/regulator via the gaming machine display or other display accessible to the authenticator/regulator. This implementation is also helpful in reducing errors introduced by humans since, for example, the authenticator or regulator is not required to manually input the output hash code value into the authentication verifying device, nor is the authenticator or regulator required to perform the comparison of the output hash code value with the predetermined value.

According to different embodiments, other information (in addition to the output hash code value information) relating to the authentication test may be output from the gaming machine. Such other information may include, for example, date information, timestamp information, hash algorithm information, seed information, gaming machine ID information, information relating to the identity of the authenticator or regulator performing the authentication test, etc.

As shown at 716, a determination is made as to whether the authentication test was successfully passed. If it is determined that the authentication test was unsuccessful, an appropriate error handling procedure may be initiated (718). Alternatively, if it is determined that the authentication test was successful, then, according to at least one implementation, the gaming machine may be configured or designed to await input for additional authentication tests (e.g., additional authentication tickets) before exiting the authentication mode of operation. Assuming that the regulator or authenticator is satisfied with the authentication test and its results, the gaming machine may exit the authentication mode of operation, and return to game play mode.

The generation of a configuration ticket and/or authentication ticket may be initiated by various entities such as, for example, a human operator, an automated program, etc. Additionally, in at least one implementation, the configuration/authentication tickets may be generated and printed using computer systems and printers which have been adapted for such a purpose. In a specific embodiment, at least a portion of the information to be included in the configuration ticket or authentication ticket may be encoded into a numerical value and printed on the ticket. Additionally, a barcode or other coded information representing the numerical value may also be printed on the ticket.

It will be appreciated that the authentication technique of the present invention provides a number of advantages over conventional gaming machine authentication techniques. One advantage of the authentication technique of the present invention is that it helps to minimize or reduce the introduction of human error into the authentication process. For example, using the technique of the present invention, authentication test input parameters may be determined by the authentication testing device and/or gaming machine without relying on a human operator to manually input such data. Another advantage of the authentication technique of the present invention is that it provides a mechanism for authentication testing to be performed without requiring, for example: (1) the removal of devices or components from the gaming machine; (2) the disarming of a number of security measures such as, for example, the unlocking and opening of the main gamming machine door; the unlocking and opening of the CPU door; the disarming any alarms which may be activated; etc. As a result, the technique of the present invention helps to decrease the risk of unauthorized tampering of the gaming machine components since there is no need to physically remove such components to perform authentication testing. As a result, the authentication technique of the present invention may be performed by non-qualified technicians (such as, for example, casino attendants or operators) and/or other persons who do not have sufficient authorization to physically remove the components being tested.

FIG. 3 illustrates an example of a portable configuration or authentication ticket 300 in accordance with specific embodiment of the present invention. For purposes of illustration, ticket 300 of FIG. 3 is shown and described in terms of a configuration ticket embodiment. However, it will be appreciated that at least a portion of the features described below with respect to ticket 300 may also be applicable to other embodiments where ticket 300 represents an authentication ticket as described, for example, in FIG. 5 of the drawings.

Ticket 300 is a paper-based ticket with configuration indicia printed on the facing side. As shown, ticket 300 mimics a paper voucher or cashout ticket used by many casinos as an alternative to traditional portable money, such as the EZPay system provided by International Gaming Technologies of Reno, Nev. However, ticket 300 has no monetary value but is intended to interface with a gaming machine to set or change game parameters on the gaming machine.

Ticket 300 displays one or more transaction information elements such as a casino identification 302, a ticket identification 304, a validation number 306, a date 308, a time 310, a ticket number 312, a value 314, and a machine identification number 316. According to a specific implementation, the validation number 306 may be a unique number generated for ticket 300 so that ticket 300 may be identified. According to a specific embodiment, the validation number 306 may be included as all or part of the information encoded in the barcode 318 portion of the ticket. Thus, for example, if the barcode becomes un-readable (e.g., ticket damaged) a human may still be able to identify at least a portion of the barcode information by reading validation number 306. Such a technique also provides a way for a user that does not have a barcode reader to determine the barcode value and identify the new configuration parameters.

Ticket 300 also includes barcode 318, which is readable by an interface associated with a gaming machine. Barcode 318 may represent a numeric value and/or other encoded information relating to gaming machine configuration parameters described, for example, with respect to FIGS. 4-8 of the drawings. It may also be used to identify which of many possible configuration tickets has been inserted and interpret the location and type of markings accordingly. An interface may optically scan barcode 318 and output a signal corresponding to barcode 318. A processor in digital communication with the interface may convert the unrefined signal to configuration numbers. Software or memory in the gaming machine stores an array of settings and parameters for each configuration number saved in memory. In one embodiment, the gaming machine includes memory that stores a dedicated number for each combination of settings and parameters in a game. Depending upon the number and position of sensors present in the interface, a multitude of indicia columns may be present on the configuration device.

Ticket 300 may be made with any type of paper. In one embodiment where a configuration device of the present invention is used to add security to a gaming system, the device comprises authorization information for the device and potentially for personnel carrying the device. Ticket 300 comprises authorization information that is authenticated by a gaming machine upon receipt of the ticket. In a specific embodiment, ticket 300 is made from security paper that may include specified materials in its composition or other security measures. Alternately, ticket 300 may include security features printed on one side. For the specific security measure selected, the interface and gaming machine are then designed with corresponding processing to a) read the security feature, and b) authenticate the security feature. Although not shown, the reverse side of ticket 300 may also include information printed thereon such as casino information, advertising, the paper manufacturer, etc.

The ability of a configuration device to function as a key, authorizing the access to and change of configurable settings may also be achieved using counterfeit resistant marketing techniques commonly found in high security notes such as currency and stocks. These techniques include: special paper or plastic substrates, ink with unique optical and/or magnetic characteristics, Intaglio printing, watermarks, security threads, embossing, Moire patterns, microprinting, taggants, and many other features.

A multitude of unique configuration tickets may be created using a combination of features such as those listed above and also by selecting staining, defacing, or otherwise permanently marking various portions of the ticket. Since a note acceptor or bill validator may obtain thousands of quantitative data measurements from the optical and magnetic sensors, a large combination of uniquely 'defaced' notes may be produced and yet still preclude creation of a counterfeit by splicing defaced portions from one ticket onto another ticket.

Ticket 300 may be produced using a printer associated with a computer not connected to a gaming machine network. As described above, this allows convenient off-line manufacture of ticket 300, or multiple tickets with the same information. In another embodiment, ticket 300 is printed by a gaming machine such as gaming machine 2 using ticket printer 18—provided the paper is provided to the gaming machine printer. In this case, gaming machine 2 is coupled to a network that allows configuration settings to be transmitted over the network to the gaming machine by a remote computer. Tickets printed in this manner may be used to configure games which are either not attached to the network or because of jurisdictional regulations, may not be reconfigured via a network directly. Use of configuration tickets in this manner allows casino personnel to roam the casino, note desirable changes based on visual observation, and effect changes without having to return to a network station.

In a specific embodiment, ticket 300 simulates a ticket used in the EZPay ticket system. The EZPay ticket system is a gaming system that allows paper tickets to be used as an alternative to traditional portable money within the gaming system. The EZPay ticket system is fully described in commonly owned U.S. patent application Ser. No. 09/648,382 entitled "Cashless Transaction Clearinghouse", which is incorporated herein by reference. Using a network that provides communication between gaming machines and various gaming machine servers in the EZPay system, ticket 300 may be produced by any printer in the EZPay ticket system. Printers in the EZPay ticket system include printers associated with an accounting server, a verification terminal, a dedicated configuration computer, an individual gaming machine, etc. The ticket may then be used to configure any gaming machine in the system. Again, a computer able to produce the configuration indicia on the ticket may be used to transmit the configuration indicia across the network to the printer, or a computer or gaming machine operating the printer. Configuration and reconfiguration may also be based on personal identification.

According to at least one implementation, the function of loading programmable/configurable parameters may be achieved according to the present invention in many ways. One may also imbed configuration information about settings or parameters into the encoding of a security key using one or more security features mentioned above. Alternatively, information on settings may be disassociated from the security function and stored on the device. Other techniques may include preprinted information symbols other than barcodes, alternate forms of symbols stored on a paper ticket, punched holes, handwritten text or symbols, etc.

The automated systems and methods of the present invention employ an interface complementary to the gaming machine configuration device. For example, if a magnetic card is used as the configuration device, an appropriate magnetic reader may be employed as the interface. Alternately, if a magnetic striped card acts as the configuration device, an appropriate magnetic stripe reader may be used. The interface digitally communicates with a processor that manages the gaming machine, and is capable of the following tasks: receiving a gaming machine configuration device, (ii) reading configuration indicia stored on the configuration device, and (iii) outputting a signal corresponding to the indicia.

Receiving the gaming machine configuration device implies that the configuration device and interface cooperate in some manner to communicate data therebetween. For portable configuration devices, the interface is typically stationary or coupled to a gaming machine and the configuration device is carried by authorized personnel to the interface. Personnel would then be responsible for providing the device to the interface to initiate the configuration or reconfiguration process. For ticket 300, the interface may be a bill validator or a similar device that reads paper tickets. In one embodiment, the present invention relies on conventional bill or note acceptor technology. Many gaming systems and gaming machines built in recent years include a note acceptor that receives and verifies paper currency. Significantly, the use of a bill validator as a configuration interface enables this capability to be offered without the costs or space requirements imposed by the use of dedicated equipment. The bill validator would then receive a configuration ticket as it would other paper devices. Namely, personnel would insert the configuration ticket in the bill validator, which allows interface sensors that detect the presence of the paper device to trigger associated handling and reading mechanisms. For example, the interface may include traction rollers that draw a paper ticket inward along a known path that includes intersection with the operative area of any number of optical scanners and sensors. The optical scanners and sensors would then read configuration indicia from the ticket automatically based on insertion of the ticket and intake by mechanical means included in the interface.

One of skill in the art will appreciate different ways that various portable devices as listed herein may be received by an associated interface. In the case of magnetic card for example, the interface may include wireless interrogation mechanisms that probe configuration indicia stored in the magnetic card. In this case, the card need only be placed in proximity to a wireless sensor associated with the interface. In the case of a magnetic striped card or a smart card containing configuration indicia, receiving the card may require authorized personnel to swipe the card through a magnetic reader.

The interface is responsible for reading configuration indicia stored on the configuration device. In the case of paper-based tickets, optical scanners and sensors are well-suited for reading configuration indicia printed on the paper. Since many conventional gaming machines include a note acceptor that receives and reads paper currency, configuration indicia in accordance with one embodiment of the present invention is printed on the paper such that it aligns with predetermined locations in which the indicia may be read using established technology. Barcode 318 of FIG. 3 is one example of this methodology.

The interface outputs a signal corresponding to indicia read from the configuration device. The interface may either transmit sensor data in a substantially unrefined form or process the data locally, using a set of algorithms that are able to recognize the configuration indicia stored on the configuration device. In the former case, the interface transmits a signal corresponding to sensor data to a processor that manages the gaming machine. For systems where digital communication is used between a gaming machine and various gaming machine peripheral devices, this implies that the interface includes a microprocessor or analog to digital technology that converts information read using an optical scanner, wireless probe, or magnetic reader to a suitable digital output. The digital communication may be sent using a proprietary or another communication protocol used between peripheral devices of a gaming machine and a gaming machine processor. In one embodiment, the interface is included within the gaming machine housing, such as the bill validator 18 included in gaming machine to of FIG. 1, and the communication of configuration information may occur across internal digital communication means, e.g., internal buses and the like. In another embodiment, the interface is a separate device that is operably coupled to the gaming machine using a serial port. In this case, proprietary and other communications protocols may be used for communication across the serial port.

Gaming System

Figure 9:
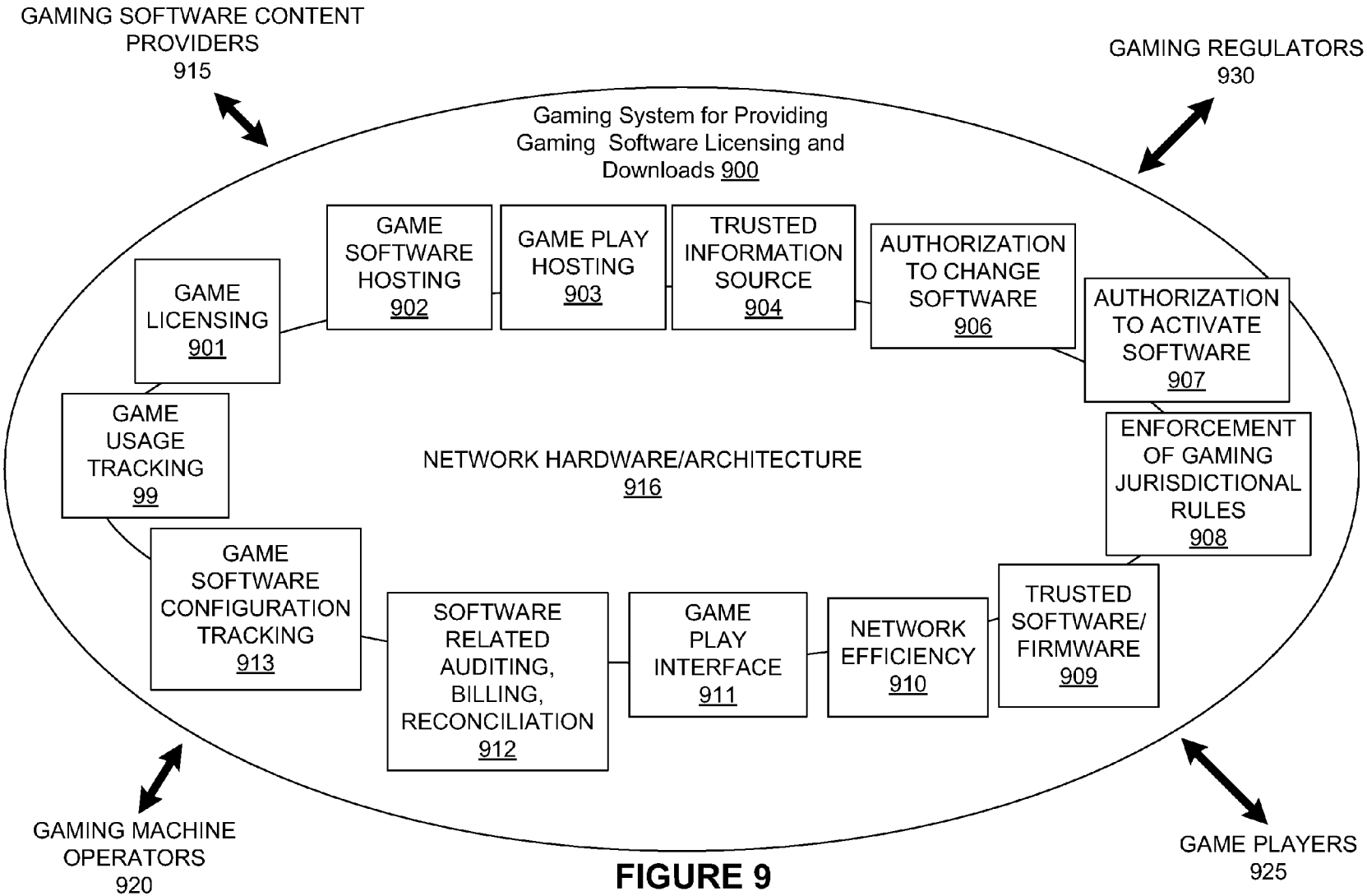
FIG. 9 shows a block diagram illustrating components of a gaming system 900 which may be used for implementing various aspects of the present invention.

FIG. 9 shows a block diagram illustrating components of a gaming system 900 which may be used for implementing various aspects of the present invention. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 may provide rules and regulations that must be applied to the gaming system and may receive reports and other information confirming that rules are being obeyed.

In the following paragraphs, details of each component and some of the interactions between the components are described with respect to FIG. 9. The game software license host 901 may be a server connected to a number of remote gaming devices that provides licensing services to the remote gaming devices. For example, in other embodiments, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in utility based licensing schemes, such as a pay-per-use scheme.

In another embodiment, a game usage-tracking host 915 may track the usage of game software on a plurality of devices in communication with the host. The game usage-tracking host 915 may be in communication with a plurality of game play hosts and gaming machines. From the game play hosts and gaming machines, the game usage tracking host 915 may receive updates of an amount that each game available for play on the devices has been played and on amount that has been wagered per game. This information may be stored in a database and used for billing according to methods described in a utility based licensing agreement.

The game software host 902 may provide game software downloads, such as downloads of game software or game firmware, to various devious in the game system 900. For example, when the software to generate the game is not available on the game play interface 911, the game software host 902 may download software to generate a selected game of chance played on the game play interface. Further, the game software host 902 may download new game content to a plurality of gaming machines via a request from a gaming machine operator.

In one embodiment, the game software host 902 may also be a game software configuration-tracking host 913. The function of the game software configuration-tracking host is to keep records of software configurations and/or hardware configurations for a plurality of devices in communication with the host (e.g., denominations, number of paylines, paytables, max/min bets). Details of a game software host and a game software configuration host that may be used with the present invention are described in co-pending U.S. Pat. No. 6,645,077, by Rowe, entitled, "Gaming Terminal Data Repository and Information System," filed Dec. 21, 2000, which is incorporated herein in its entirety and for all purposes.

A game play host device 903 may be a host server connected to a plurality of remote clients that generates games of chance that are displayed on a plurality of remote game play interfaces 911. For example, the game play host device 903 may be a server that provides central determination for a bingo game play played on a plurality of connected game play interfaces 911. As another example, the game play host device 903 may generate games of chance, such as slot games or video card games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

In particular embodiments, the game play interfaces or other gaming devices in the gaming system 900 may be portable devices, such as electronic tokens, cell phones, smart cards, tablet PC's and PDA's. The portable devices may support wireless communications and thus, may be referred to as wireless mobile devices. The network hardware architecture 916 may be enabled to support communications between wireless mobile devices and other gaming devices in gaming system. In one embodiment, the wireless mobile devices may be used to play games of chance.

The gaming system 900 may use a number of trusted information sources. Trusted information sources 904 may be devices, such as servers, that provide information used to authenticate/activate other pieces of information. CRC values used to authenticate software, license tokens used to allow the use of software or product activation codes used to activate to software are examples of trusted information that might be provided from a trusted information source 904. Trusted information sources may be a memory device, such as an EPROM, that includes trusted information used to authenticate other information. For example, a game play interface 911 may store a private encryption key in a trusted memory device that is used in a private key-public key encryption scheme to authenticate information from another gaming device.

When a trusted information source 904 is in communication with a remote device via a network, the remote device will employ a verification scheme to verify the identity of the trusted information source. For example, the trusted information source and the remote device may exchange information using public and private encryption keys to verify each other's identities. In another embodiment of the present invention, the remote device and the trusted information source may engage in methods using zero knowledge proofs to authenticate each of their respective identities. Details of zero knowledge proofs that may be used with the present invention are described in US publication no. 2003/0203756, by Jackson, filed on Apr. 25, 2002 and entitled, "Authentication in a Secure Computerized Gaming System", which is incorporated herein in its entirety and for all purposes.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

The gaming system 900 of the present invention may include devices 906 that provide authorization to download software from a first device to a second device and devices 907 that provide activation codes or information that allow downloaded software to be activated. The devices, 906 and 907, may be remote servers and may also be trusted information sources. One example of a method of providing product activation codes that may be used with the present invention is describes in previously incorporated U.S. Pat. No. 6,264,561.

A device 906 that monitors a plurality of gaming devices to determine adherence of the devices to gaming jurisdictional rules 908 may be included in the system 900. In one embodiment, a gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRC's, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum bet limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. In one embodiment, when a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may used to check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, i.e., game software approved for use on gaming devices by a local gaming jurisdiction may be required on gaming devices on the gaming machine.

In the present invention, the devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, in the present inventions, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices in the present invention may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. In one embodiment, the software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

There are many possible interactions between the components described with respect to FIG. 9. Many of the interactions are coupled. For example, methods used for game licensing may affect methods used for game downloading and vice versa. For the purposes of explanation, details of a few possible interactions between the components of the system 900 relating to software licensing and software downloads have been described. The descriptions are selected to illustrate particular interactions in the game system 900. These descriptions are provided for the purposes of explanation only and are not intended to limit the scope of the present invention.

OTHER EMBODIMENTS

The present invention may be characterized by a number of different embodiments. Examples of at least some of the different embodiments of the present invention are described below.

One embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; and/or implementing configuration or reconfiguration of the gaming machine using the at least one configuration parameter.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; disabling game play on the gaming machine while the gaming machine is in the configuration mode of operation.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; receiving a wager on a game of chance; generating an outcome for the game of chance using the at least one configuration parameter.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; accepting information provided by the configuration device while the gaming machine is in the configuration mode of operation; rejecting information provided by the configuration device while the gaming machine is in a game play mode of operation.

Another embodiment of the present invention relates to different methods, gaming machines, systems, and computer program products for facilitating configuration of a gaming machine which includes a main door for providing access to internal components of the gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; changing the at least one configuration parameter of the gaming machine without the main door being opened.

Another embodiment of the present invention relates to different methods, gaming machines, systems, and computer program products for facilitating configuration of a gaming machine which includes a plurality of internal components. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; changing the at least one configuration parameter of the gaming machine without physically removing any of the internal components from the gaming machine.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; wherein the at least one configuration parameter corresponds to a configuration parameter selected from: country code parameters, bill limit parameters, voucher limit parameters, credit limit parameters, accounting model parameters, operating model parameters, communication protocol parameters, default display parameters, default button assignment parameters, game configuration parameters, and game selection parameters.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; wherein the configuration indicia includes a numeric or alphabetic code usable for determining the at least one configuration parameter.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; identifying at least one security feature associated with the configuration device; validating the configuration device using the at least one security feature; implementing configuration or reconfiguration of the gaming machine in response to approval of the validation of the configuration device. In one implementation, the at least one security feature may include information relating to an identifier for uniquely identifying the gaming machine.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; wherein the gaming machine configuration device corresponds to a configuration ticket, and wherein the gaming machine includes a bill validator module; detecting that the configuration ticket has been inserted into the bill validator module; reading, using the bill validator module, the configuration indicia from the configuration ticket.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; automatically mapping the configuration indicia to at least one predetermined configuration parameter stored within local memory of the gaming machine.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; automatically selecting the at least one configuration parameter from configuration parameter information stored in local memory of the gaming machine.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; providing the configuration indicia to a remote server; receiving configuration information from the remote server in response to providing the configuration indicia to the remote server; wherein the configuration information includes the at least one configuration parameter.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; extracting the at least one configuration parameter from the configuration indicia stored on the configuration device.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; authenticating the configuration device before implementing configuration or reconfiguration of the gaming machine.

Another embodiment of the present invention relates to different methods, gaming machines, systems, and computer program products for facilitating configuration of a gaming machine. Such methods, gaming machines, systems, and/or computer program products may be configured or designed to include one or more of the following features: receiving first input for changing an operating mode of the gaming machine to a configuration mode of operation; changing the operating mode of the gaming machine to the configuration mode of operation in response to the first input; detecting a presence of a gaming machine configuration device; reading configuration indicia stored on the configuration device; automatically determining, using the configuration indicia, at least one configuration parameter relating to configuration of the gaming machine; implementing configuration or reconfiguration of the gaming machine using the at least one configuration parameter; authenticating the configuration device via a remote server.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; receiving first input for changing an operating mode of the gaming machine to a authentication mode of operation; changing the operating mode of the gaming machine to the authentication mode of operation in response to the first input.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; disabling game play on the gaming machine while the gaming machine is in the authentication mode of operation.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; accepting information provided by the authentication device while the gaming machine is in the authentication mode of operation; rejecting information provided by the authentication device while the gaming machine is in a game play mode of operation.

Another embodiment of the present invention relates to different methods, gaming machines, systems, and computer program products for facilitating authentication testing of a first gaming machine component in order to determine an authenticity of the first component, wherein the gaming machine includes a main door for providing access to internal components of the gaming machine. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; performing authentication testing on the first component of the gaming machine without the main door being opened Another embodiment of the present invention relates to different methods, gaming machines, systems, and computer program products for facilitating authentication testing of a first gaming machine component in order to determine an authenticity of the first component, wherein the gaming machine includes a plurality of internal components. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; performing authentication testing on the first component of the gaming machine without physically removing any of the internal components from the gaming machine.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first component corresponds to a trusted memory device associated with the gaming machine.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first component corresponds to a firmware associated with the gaming machine.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first component corresponds to software code associated with the gaming machine.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first component corresponds to a peripheral device associated with the gaming machine.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the external entity corresponds to a human operator performing an authentication test of the at least one gaming machine component, and wherein the gaming machine includes a display; displaying the authentication output data to the human operator via the gaming machine display.

Another embodiment of the present invention relates to different methods, gaming machines, systems, and computer program products for facilitating authentication testing of a first gaming machine component in order to determine an authenticity of the first component, wherein the gaming machine includes a ticket printing module. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; printing, using the ticket printing module, an authentication output ticket which includes authentication output data.

Another embodiment of the present invention relates to different methods, gaming machines, systems, and computer program products for facilitating authentication testing of a first gaming machine component in order to determine an authenticity of the first component, wherein the gaming machine includes a ticket printing module. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; printing, using the ticket printing module, an authentication output ticket which includes authentication output data; reading the authentication output data from the authentication output ticket; comparing the authentication output data to predetermined data; determining an outcome of the authentication test of the first gaming machine component based at least in part on the comparison of the authentication output data with the predetermined data.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the external entity corresponds to a remote computer system.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the authentication information and includes hash algorithm information relating to a selected hash algorithm; seed information relating to a selected randomization seed value;

wherein the authentication output data is generated using the selected hash algorithm and randomization seed value.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first gaming machine component corresponds to game code stored in memory of the gaming machine; applying a selected hash algorithm to at least a portion of the game code to thereby generate a hash code value; wherein the authentication output data corresponds to the hash code value.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first gaming machine component corresponds to a trusted memory device associated with gaming machine; applying a selected hash algorithm to at least a portion of data stored in the trusted memory device to thereby generate a hash code value; wherein the authentication output data corresponds to the hash code value; comparing the authentication output data to predetermined data; determining an outcome of the authentication test of the first gaming machine component based at least in part on the comparison of the authentication output data with the predetermined data. In one implementation, the trusted memory device may include unalterable memory.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first gaming machine component corresponds to game data associated with gaming machine; applying a selected hash algorithm to at least a portion of the game data to thereby generate a hash code value; wherein the authentication output data corresponds to the hash code value; comparing the authentication output data to predetermined data; determining an outcome of the authentication test of the first gaming machine component based at least in part on the comparison of the authentication output data with the predetermined data.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first gaming machine component corresponds to at least one operating system component associated with gaming machine; applying a selected hash algorithm to at least a portion of the at least one operating system component to thereby generate a hash code value; wherein the authentication output data corresponds to the hash code value; comparing the authentication output data to predetermined data; determining an outcome of the authentication test of the first gaming machine component based at least in part on the comparison of the authentication output data with the predetermined data.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the first gaming machine component corresponds operating code associated with gaming machine; applying a selected hash algorithm to the operating code to thereby generate a hash code value; wherein the authentication output data corresponds to the hash code value; comparing the authentication output data to predetermined data; determining an outcome of the authentication test of the first gaming machine component based at least in part on the comparison of the authentication output data with the predetermined data.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the authentication information corresponds to a code from which the hash algorithm information and seed information may be determined.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the gaming machine authentication device corresponds to a authentication ticket, and wherein the gaming machine includes a bill validator module; detecting that the authentication ticket has been inserted into the bill validator module; reading, using the bill validator module, the authentication information from the authentication ticket.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the gaming machine authentication device corresponds to an authentication ticket, and wherein the gaming machine includes a ticket printer module; printing, using the ticket printer module, an authentication output ticket which includes the authentication output data.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the gaming machine authentication device corresponds to an authentication ticket, and wherein the gaming machine includes a printer module; printing, using the printer module, a receipt which includes information relating to at least one authentication test performed on the first component.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the gaming machine authentication device corresponds to an authentication ticket, and wherein the gaming machine includes a barcode scanner; reading, using the barcode scanner, the authentication information from the authentication ticket.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the gaming machine authentication device includes a first wireless communication device, and wherein the gaming machine includes a second wireless communication device; receiving, via the second wireless communication device, the authentication information from the authentication device.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; providing the authentication output information to a remote server; receiving authentication verification information from the remote server in response to providing the authentication output information to the remote server.

Another embodiment of the present invention relates to different methods, gaming machines, systems, and computer program products for facilitating authentication testing of a first gaming machine component in order to determine an authenticity of the first component. Such methods, gaming machines, systems, and/or computer program products may be configured or designed to include one or more of the following features: detecting a presence of a gaming machine authentication device; reading authentication information stored on the authentication device; performing a first authentication test on the first component using at least a portion of the authentication information; generating, in response to the first authentication test, authentication output data; providing the authentication output data to an external entity; wherein the authentication information and includes hash algorithm information relating to a selected hash algorithm; seed information relating to a selected randomization seed value; wherein the authentication output data includes a hash code representing the first component, the hash code being generated using the selected hash algorithm and randomization seed value.

Other aspects of gaming machine component authentication are described in U.S. patent application Ser. No. 10/187,102 entitled "SCAN BASED CONFIGURATION CONTROL IN A GAMING ENVIRONMENT" by Parrott et al., filed on Jun. 27, 2002, the entirety of which is incorporated herein by reference for all purposes.

Although several preferred embodiments of this invention have been described in detail herein with reference to the accompanying drawings, it is to be understood that the invention is not limited to these precise embodiments, and that various changes and modifications may be effected therein by one skilled in the art without departing from the scope of spirit of the invention as defined in the appended claims.

It is claimed:

1. A gaming device in a gaming network, comprising:
a master gaming controller;
memory;
a first display;
at least one interface for communicating with at least one other device in the gaming network; and
the master gaming controller of the gaming device being operable to:
control a wager-based game played at the gaming device,
detect a presence of a gaming component authentication ticket,
receive an input for changing an operating mode of the gaming device to an authentication mode of operation and change the operating mode of the gaming device to the authentication mode of operation in response to the input,
read authentication information stored on the gaming component authentication ticket, the authentication information including an identification of an algorithm to perform a first authentication test and parameters to use as input for the algorithm,
perform, using at least a portion of the authentication information, the first authentication test on a first selected component of a plurality of components located within a housing of the gaming device in order to test whether the first selected component is authentic,
generate, in response to the first authentication test, authentication output data relating to the first selected component, and
provide the authentication output data to an external entity.

2. The gaming device of claim 1 further comprising an input mechanism for receiving cash or an indicia of credit.

3. The gaming device of claim 1 being further operable to:
disable game play on the gaming device while the gaming device is in the authentication mode of operation.

4. The gaming device of claim 1 being further operable to:
accept information provided by the gaming component authentication ticket while the gaming device is in the authentication mode of operation; and
reject information provided by the gaming component authentication ticket while the gaming device is in a game play mode of operation.

5. The gaming device of claim 1 wherein the housing defines an interior cavity, the first component being located within the interior cavity, the gaming device being further operable to:
enable a user to perform the first authentication test of the first component of the gaming device using the gaming component authentication ticket without allowing physical access to the interior cavity.

6. The gaming device of claim 1 the gaming device being further operable to:
enable a user to perform the first authentication test on the first component of the gaming device without physically removing any of the plurality of components from the gaming device.

7. The gaming device of claim 1 wherein the first component corresponds to a component selected from a group consisting of: an unalterable memory component; a firmware component associated with the gaming device; a software component stored within the memory of the gaming device; and a peripheral device associated with the gaming device.

8. The gaming device of claim 1 wherein the external entity corresponds to a human operator performing the first authentication test of the first component, and wherein the gaming device includes a display, the gaming device being further operable to:
display the authentication output data to the human operator via the gaming device display.

9. The gaming device of claim 1 wherein the gaming device includes a ticket print module, the gaming device being further operable to:
print, using the ticket print module, an authentication output ticket which includes authentication output data.

10. The gaming device of claim 1 wherein the gaming device includes a ticket print module, the gaming device being further operable to:
print, using the ticket print module, an authentication output ticket which includes authentication output data;
read the authentication output data from the authentication output ticket;
compare the authentication output data to predetermined data; and
determine an outcome of the first authentication test of the first component based at least in part on the comparison of the authentication output data with the predetermined data, the outcome including information of whether the first selected component is authentic.

11. The gaming device of claim 1 wherein the external entity corresponds to a remote computer system.

12. The gaming device of claim 1
wherein the identification of the algorithm includes hash algorithm information relating to a selected hash algorithm; and
wherein the parameters include seed information relating to a selected randomization seed value;
wherein the authentication output data is generated using the selected hash algorithm and randomization seed value.

13. The gaming device of claim 1 wherein the first component corresponds to game code stored in memory of the gaming device, the gaming device being further operable to:
apply a selected hash algorithm to at least a portion of the game code to thereby generate a hash code value; and
wherein the authentication output data corresponds to the hash code value.

14. The gaming device of claim 1 wherein the first component corresponds to an unalterable memory device associated with the gaming device, the gaming device being further operable to:
apply a selected hash algorithm to at least a portion of data stored in the unalterable memory device to thereby generate a hash code value;

wherein the authentication output data corresponds to the hash code value;

compare the authentication output data to predetermined data; and determine an outcome of the authentication test of the first component based at least in part on the comparison of the authentication output data with the predetermined data.

15. The gaming device of claim 1:

wherein the first component includes at least one component selected from a group consisting of: a portion of executable code stored in the memory of the gaming device, and an operating system component associated with gaming device;

the gaming device being further operable to:

apply a selected hash algorithm to at least a portion of the first component to thereby generate a hash code value;

wherein the authentication output data corresponds to the hash code value;

compare the authentication output data to predetermined data; and determine an outcome of the authentication test of the first component based at least in part on the comparison of the authentication output data with the predetermined data.

16. The gaming device of claim 1 wherein the gaming component authentication device corresponds to an authentication ticket, and wherein the gaming device includes a bill validator module, the gaming device being further operable to:

detect that the authentication ticket has been inserted into the bill validator module; and read, using the bill validator module, the authentication information from the authentication ticket.

17. The gaming device of claim 1 wherein the gaming component authentication device corresponds to an authentication ticket, and wherein the gaming device includes a ticket printer module, the gaming device being further operable to:

print, using the ticket printer module, an authentication output ticket which includes the authentication output data.

18. The gaming device of claim 1 wherein the gaming component authentication device corresponds to an authentication ticket, and wherein the gaming device includes a barcode scanner, the gaming device being further operable to:

read, using the barcode scanner, the authentication information from the authentication ticket.

19. The gaming device of claim 1 wherein the gaming component authentication device includes a first wireless communication device, and wherein the gaming device includes a wireless communication interface, the gaming device being further operable to:

receive, via the wireless communication interface, the authentication information from the gaming component authentication device.

20. The gaming device of claim 1 being further operable to:

provide the authentication output information to a remote server; and receive authentication verification information from the remote server in response to providing the authentication output information to the remote server.

21. The gaming device of claim 1 wherein the authentication information includes:

hash algorithm information relating to a selected hash algorithm; and seed information relating to a selected randomization seed value;

wherein the authentication output data includes a hash code representing the first component, said hash code being generated using the selected hash algorithm and randomization seed value.

22. A gaming machine comprising:

at least one processor;

at least one interface;

at least one display;

memory; and the at least one processor of the gaming machine being operable to:

detect a presence of a first instrument comprising authentication information, receive an input for changing an operating mode of the gaming machine to an authentication mode of operation and change the operating mode of the gaming machine to the authentication mode of operation in response to the input, read authentication information stored at the first instrument, the authentication information including an identification of an algorithm to perform a first authentication test and parameters to use as input for the algorithm, determine whether the authentication information is valid;

perform, in response to the determination that the authentication information is valid, a first authentication test on a first selected component of a plurality of components located within a housing of the gaming machine using at least a portion of the authentication information in order to test whether the first selected component is authentic, generate, in response to performing the first authentication test, authentication output data relating to the first selected component, and provide the authentication output data to an external entity.

23. The gaming machine of claim 22 wherein the first instrument includes encrypted configuration indicia, and further includes encryption signature information, the gaming machine being further operable to:

read the encryption signature information stored at the first instrument;

read the encrypted configuration indicia stored at the first instrument; and wherein the determination of whether the authentication information is valid includes validating authenticity of the encrypted configuration indicia using the encryption signature information.

24. The gaming machine of claim 22 wherein the housing defines an interior cavity, the first component being located within the interior cavity, the gaming machine being further operable to:

enable a user to perform the first authentication test of the first component of the gaming machine using the first instrument without allowing physical access to the interior cavity.

25. The gaming machine of claim 22 wherein the first component corresponds to a component selected from a group consisting of: an unalterable memory component; a firmware component associated with the gaming machine; a software component stored within the memory of the gaming machine; and a peripheral device associated with the gaming machine.

26. The gaming machine of claim 22:

wherein the first component includes at least one component selected from a group consisting of: a portion of executable code stored in the memory of the gaming machine, and an operating system component associated with gaming device;

the gaming machine being further operable to:

apply a selected hash algorithm to at least a portion of the first gaming device component to thereby generate a hash code value;

wherein the authentication output data corresponds to the hash code value;

compare the authentication output data to predetermined data; and determine an outcome of the authentication test of the first component based at least in part on the comparison of the authentication output data with the predetermined data.

27. The gaming machine of claim 22 wherein the first instrument corresponds to a physical ticket, and wherein the gaming machine includes a bill validator module, the gaming machine being further operable to:

detect that the physical ticket has been inserted into the bill validator module; and read, using the bill validator module, the authentication information from the physical ticket.

28. The gaming machine of claim 22 wherein the authentication information includes:

wherein the identification of the algorithm includes hash algorithm information relating to a selected hash algorithm; and wherein the parameters include seed information relating to a selected randomization seed value;

wherein the authentication output data includes a hash code representing the first component, said hash code being generated using the selected hash algorithm and randomization seed value.

29. A gaming machine comprising:

at least one processor;

memory;

a display;

the at least one processor configured to:

control a wager-based game played on the gaming machine, detect a presence of a first instrument comprising authentication information, receiving an input for changing an operating mode of the gaming machine to an authentication mode of operation and changing the operating mode of the gaming machine to the authentication mode of operation in response to the input, read authentication information stored at the first instrument, the authentication information including an identification of an algorithm to perform a first authentication test and parameters to use as input for the algorithm;

perform the first authentication test, according to an algorithm identified by the authentication information, on a first selected component of a plurality of components located within a housing of the gaming machine using at least a portion of the authentication information to test whether the first selected component is authentic, generate, in response to performing the first authentication test, authentication output data relating to the first selected component, provide the authentication output data to an external entity, and receive, from the external entity, an outcome indicating whether the first selected component is authentic based on the authentication output data.

* * * * *